US009658553B2

(12) United States Patent
Sekiguchi et al.

(10) Patent No.: US 9,658,553 B2
(45) Date of Patent: May 23, 2017

(54) TONER

(71) Applicant: CANON KABUSHIKI KAISHA, Tokyo (JP)

(72) Inventors: Takeshi Sekiguchi, Kawasaki (JP); Shosei Mori, Hiratsuka (JP); Taichi Shintou, Saitama (JP); Takeshi Miyazaki, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/024,811

(22) PCT Filed: Sep. 24, 2014

(86) PCT No.: PCT/JP2014/076231
§ 371 (c)(1),
(2) Date: Mar. 24, 2016

(87) PCT Pub. No.: WO2015/046617
PCT Pub. Date: Apr. 2, 2015

(65) Prior Publication Data

US 2016/0216625 A1 Jul. 28, 2016

(30) Foreign Application Priority Data

Sep. 27, 2013 (JP) ..... 2013-201703

(51) Int. Cl.
*G03G 9/09* (2006.01)
*G03G 9/08* (2006.01)

(52) U.S. Cl.
CPC ..... *G03G 9/091* (2013.01); *G03G 9/0804* (2013.01); *G03G 9/0806* (2013.01); *G03G 9/0924* (2013.01)

(58) Field of Classification Search
CPC ..... G03G 9/091
See application file for complete search history.

(56) References Cited

U.S. PATENT DOCUMENTS

| | | | | |
|---|---|---|---|---|
| 6,576,748 | B1 | 6/2003 | Carlini | |
| 6,673,139 | B1 * | 1/2004 | Wu | C09D 11/34 106/31.29 |
| 2016/0238756 | A1 * | 8/2016 | Sekiguchi | C09B 33/12 |

FOREIGN PATENT DOCUMENTS

| | | | |
|---|---|---|---|
| JP | 48-030734 | A | 4/1973 |
| JP | 7-140716 | A | 6/1995 |
| JP | 11-282208 | A | 10/1999 |
| JP | 2004-526836 | A | 9/2004 |
| JP | 2011-257706 | A | 12/2011 |

* cited by examiner

*Primary Examiner* — Hoa V Le
(74) *Attorney, Agent, or Firm* — Canon U.S.A., Inc., IP Division

(57) ABSTRACT

The present invention provides a toner excellent in both saturation and light resistance. The toner includes toner particles containing a binder resin and a colorant. The colorant is a pyridoneazo compound having a specific structure.

8 Claims, 1 Drawing Sheet

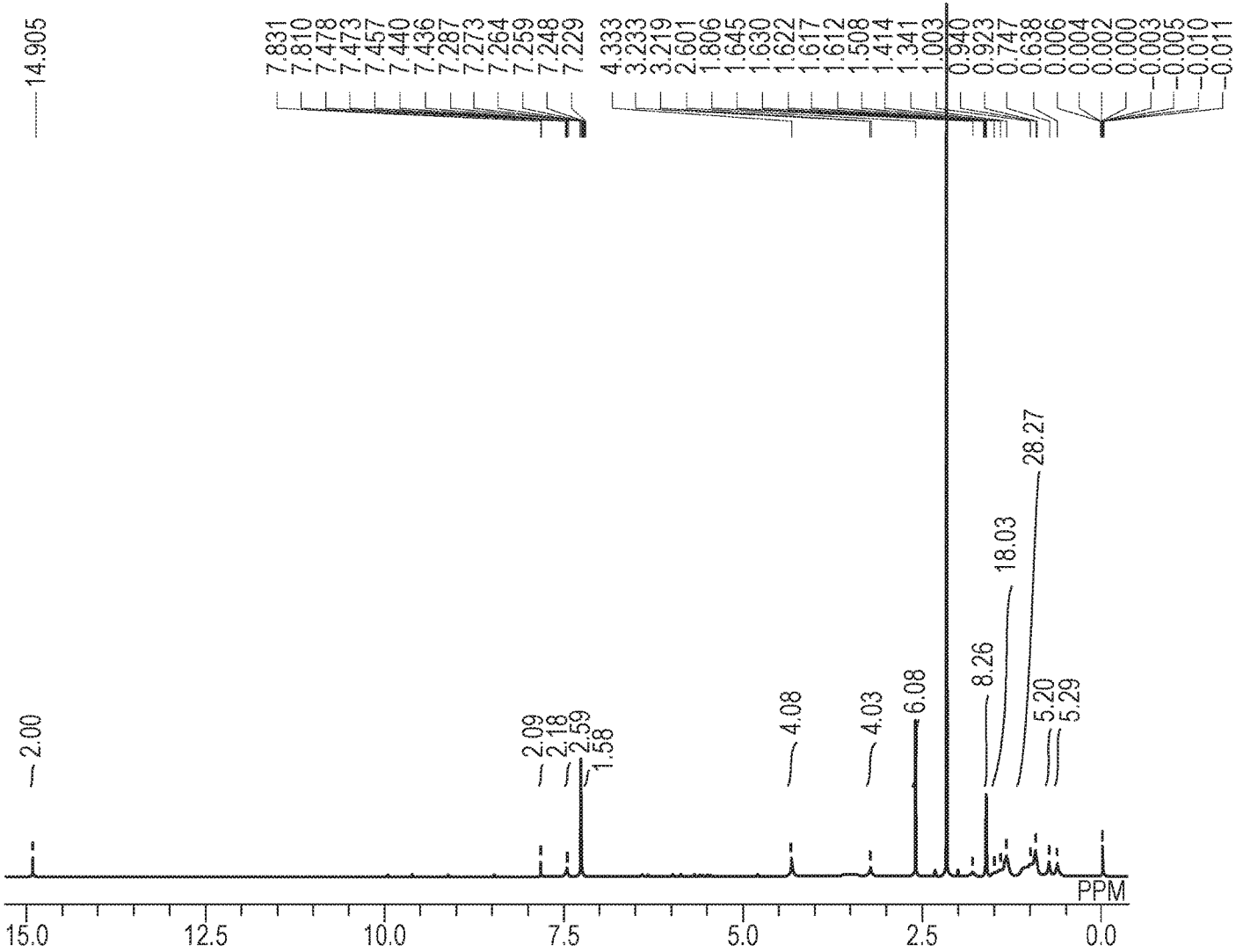
PPM
0.0
2.5
5.0
7.5
10.0
12.5
15.0
14.905
2.00
7.831
7.810
7.478
7.473
7.457
7.440
7.436
7.287
7.273
7.264
7.259
7.248
7.229
4.333
3.233
3.219
2.601
1.806
1.645
1.630
1.622
1.617
1.612
1.508
1.414
1.341
1.003
0.940
0.923
0.747
0.638
0.006
0.004
0.002
0.000
-0.003
-0.005
-0.010
-0.011
2.09
2.18
2.59
1.58
4.08
4.03
6.08
8.26
18.03
28.27
5.20
5.29

TONER

TECHNICAL FIELD

The present invention relates to a toner that is used in a recording method such as electrophotography, electrostatic recording, magnetic recording, or toner jetting.

BACKGROUND ART

In recent years, color images have become popular, and a demand for high resolution has been increasing. In digital full color copiers and printers, an original color image is subjected to color separation with filters of blue, green, and red, and then a latent image corresponding to the original image is developed using developers of yellow, magenta, cyan, and black. Therefore, the tinting strength of each colorant contained in the developer of each color highly affects the image quality.

In addition, the reproducibility in color space, such as the Japan Color standard in the printing industry and Adobe RGB in the Desk Top Publishing (DTP), is an important factor. In the reproducibility of color space, it is known to improve the dispersibility of pigment or to use a dye having a broad color gamut.

As examples of yellow colorants for toner, compounds having an isoindolinone, quinophthalone, anthraquinone, or azo skeleton are known. Although these compounds are widely used as pigments, they have limitations in transparency and tinting strength, which are improved by using dyes. For example, a pyridoneazo compound (monomer) having one azo bond is known as a yellow colorant (see PTLs 1 and 2).

However, a dye having further excellent saturation and light resistance is demanded to be developed for improving image quality.

CITATION LIST

Patent Literature

PTL 1 Japanese Patent Laid-Open No. 7-140716

PTL 2 Japanese Patent Laid-Open No. 11-282208

SUMMARY OF INVENTION

Technical Problem

The present invention provides a toner being excellent in both saturation and light resistance.

Solution to Problem

The problems described above can be solved by the following invention.

That is, the present invention provides a toner including toner particles containing a binder resin and a colorant. The colorant is a coloring compound represented by Formula (1).

[Chem. 1]

Formula (1)

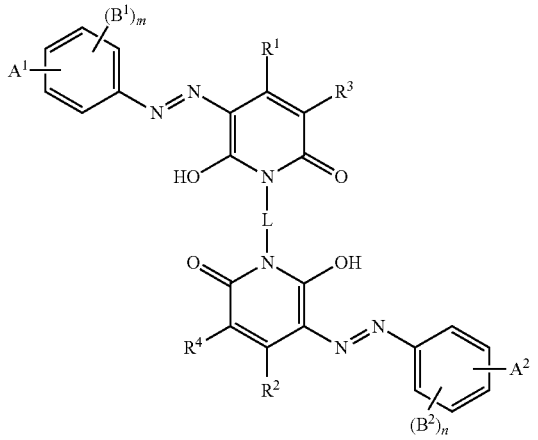

Advantageous Effects of Invention

The present invention can provide a toner being excellent in both saturation and light resistance.

BRIEF DESCRIPTION OF DRAWINGS

FIG. 1 is a $^1$H-NMR spectrum of coloring compound (1), used in Example 1, in $CDCl_3$ at room temperature at 400 MHz.

DESCRIPTION OF EMBODIMENTS

The present invention will now be described by embodiments for implementing the invention.

The present inventors have diligently studied for solving the above-mentioned problems and, as a result, have found that a coloring compound represented by Formula (1) has high compatibility to a binder resin and is uniformly dissolved in the binder resin during the process of producing a toner and that a toner containing the binder resin and the coloring compound represented by Formula (1) of the present invention can be excellent in both saturation and light resistance, and have accomplished the present invention.

The coloring compound represented by Formula (1) used in the present invention is characterized in that the N-positions of pyridone rings are linked to each other via an alkylene group or a phenylene group. The linking enhances the compatibility of the coloring compound to a binder resin, prevents the coloring compound molecules from stacking, and enhances the dispersibility, resulting in an improvement in saturation. The dimerization by linking of the pyridone rings in the coloring compound used in the present invention enhances the relaxation of the excited state of the coloring compound to improve the light resistance compared to that in the monomer of the pyridone ring.

In addition, the introduction of a group that enhances the relaxation of an excited state, such as a carboxylic acid amido group, into the phenyl group adjacent to the azo group provides an effect of increasing the light resistance. In particular, the phenyl group having a carboxylic acid long-chain alkyl amido group further enhances the compatibility of the coloring compound to a binder resin to improve the saturation.

In contrast, when the phenyl group adjacent to the azo group has a long-chain alkyl group suppressing the relaxation of the excited state of the coloring compound, the compatibility of the coloring compound to a binder resin is decreased. As a result, resulting toners have low saturation and light resistance.

[Chem. 2]

Formula (1)

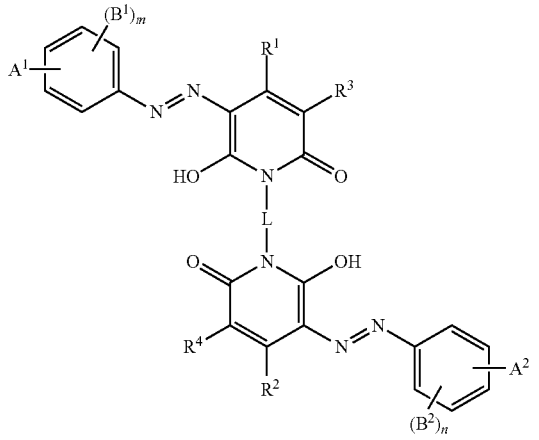

In Formula (1), $R^1$ and $R^2$ each independently represent an alkyl group, an aryl group, or an amino group; $R^3$ and $R^4$ each independently represent a hydrogen atom, a cyano group, a carbamoyl group, a carboxylic acid ester group, or a carboxylic acid amido group; m and n each independently represent an integer of 0 to 4; $A^1$, $A^2$, $B^1$ when m is 1 to 4, and $B^2$ when n is 1 to 4 each independently represent a carboxylic acid ester group, a sulfonic acid ester group, a carboxylic acid amido group, or a sulfonic acid amido group; and L represents a straight chain alkylene group having 1 to 12 carbon atoms, a branched alkylene group having 1 to 12 carbon atoms, or a phenylene group.

Coloring Compound

The coloring compound represented by Formula (1) will be described.

In Formula (1), $R^1$ and $R^2$ each independently represent an alkyl group, an aryl group, or an amino group.

The alkyl group represented by $R^1$ or $R^2$ in Formula (1) is not particularly limited, and examples thereof include methyl, ethyl, n-propyl, iso-propyl, n-butyl, sec-butyl, iso-butyl, and tert-butyl groups.

The aryl group represented by $R^1$ or $R^2$ in Formula (1) is not particularly limited, and examples thereof include a phenyl group.

The amino group represented by $R^1$ or $R^2$ in Formula (1) is not particularly limited, and examples thereof include amino and dimethylamino groups.

When $R^1$ and $R^2$ in Formula (1) each independently represent an alkyl group, in particular, a methyl group, the coloring compound can provide a toner having excellent saturation and light resistance.

In Formula (1), $R^3$ and $R^4$ each independently represent a hydrogen atom, a cyano group, a carbamoyl group, a carboxylic acid ester group, or a carboxylic acid amido group.

The carboxylic acid ester group represented by $R^3$ or $R^4$ in Formula (1) is not particularly limited, and examples thereof include a carboxylic acid methyl ester group, a carboxylic acid ethyl ester group, a carboxylic acid butyl ester group, and a carboxylic acid ethylhexyl ester group.

Examples of the carboxylic acid amido group represented by $R^3$ or $R^4$ in Formula (1) include carboxylic acid dialkylamido groups such as a carboxylic acid dimethyl amido group and a carboxylic acid diethylamido group; and carboxylic acid monoalkylamido groups such as a carboxylic acid methylamido group and a carboxylic acid ethylamido group.

When $R^3$ and $R^4$ in Formula (1) each represent a cyano group, the coloring compound can provide a toner having excellent saturation and light resistance.

L in Formula (1) represents a straight chain alkylene group having 1 to 12 carbon atoms, a branched alkylene group having 1 to 12 carbon atoms, or a phenylene group.

The alkylene group represented by L in Formula (1) is not particularly limited and may be a straight chain or branched. Examples of the alkylene group include a methylene group, an ethylene group, a propylene group, a butylene group, a pentylene group, a hexylene group, a heptylene group, an octylene group, a nonylene group, a decylene group, a dodecylene group, and a hexadecylene group. In particular, a methylene, ethylene, propylene, or butylene group can be used. When L represents an ethylene group, the coloring compound can provide a toner having excellent saturation and light resistance.

The phenylene group represented by L in Formula (1) is not particularly limited, and examples thereof include a 1,2-disubstituted phenylene group, a 1,3-disubstituted phenylene group, and a 1,4-disubstituted phenylene group. In particular, when L represents a 1,3-disubstituted phenylene group, the coloring compound can provide a toner having excellent saturation and light resistance.

In Formula (1), m and n each independently represent an integer of 0 to 4, preferably 0 or 1, and most preferably 0.

$A^1$, $A^2$, $B^1$ when m is 1 to 4, and $B^2$ when n is 1 to 4 each independently represent a carboxylic acid ester group, a sulfonic acid ester group, a carboxylic acid amido group, or a sulfonic acid amido group.

Furthermore, $A^1$ and $B^1$ may be the same, and $A^2$ and $B^2$ may the same. When m represents an integer 2 to 4, $B^1$'s may be the same or different. The same applies to $B^2$.

In Formula (1), the carboxylic acid amido group represented by $A^1$, $A^2$, $B^1$, or $B^2$ is not particularly limited, and examples thereof include carboxylic acid dialkylamido groups such as a carboxylic acid dimethylamido group, a carboxylic acid diethylamido group, a carboxylic acid di(ethylhexyl)amido group, and a carboxylic acid di(2-ethylhexyl)amido group; and carboxylic acid monoalkylamido groups such as a carboxylic acid methylamido group, a carboxylic acid ethylamido group, a carboxylic acid (ethylhexyl)amido group, and a carboxylic acid (2-ethylhexyl) amido group. In particular, the carboxylic acid amido group can be a carboxylic acid dialkylamido group. When $A^1$, $A^2$, $B^1$, or $B^2$ is a carboxylic acid di(2-ethylhexyl)amido group, the coloring compound can provide a toner having excellent saturation and light resistance.

In Formula (1), m and n can be 0. In such a case, at least one of $A^1$ and $A^2$ can be a carboxylic acid dialkylamido group, in particular, a carboxylic acid di(2-ethylhexyl)amido group.

In Formula (1), the sulfonic acid ester group represented by $A^1$, $A^2$, $B^1$, or $B^2$ is not particularly limited, and examples thereof include a sulfonic acid methyl ester group, a sulfonic acid ethyl ester group, a sulfonic acid butyl ester group, a sulfonic acid ethylhexyl ester group, and a sulfonic acid (2-ethylhexyl) ester group. In particular, when $A^1$, $A^2$, $B^1$, or $B^2$ is a sulfonic acid (2-ethylhexyl) ester group, the coloring compound can provide a toner having excellent saturation and light resistance.

In Formula (1), the sulfonic acid amido group represented by $A^1$, $A^2$, $B^1$, or $B^2$ is not particularly limited, and examples thereof include sulfonic acid alkylamido groups such as a sulfonic acid methylamido group and a sulfonic acid ethylamido group; and a sulfonic acid (2-ethylhexyl)amido group. In particular, when $A^1$, $A^2$, $B^1$, or $B^2$ is a sulfonic acid (2-ethylhexyl)amido group, the coloring compound can provide a toner having excellent saturation and light resistance.

In Formula (1), the partial structures on both sides of L can be the same. In such a case, the coloring compound can provide a toner having excellent saturation and light resistance.

In Formula (1), the combination of L with $A^1$, $A^2$, $B^1$, and $B^2$ can be the following combination:

i) in Formula (1), L represents a phenylene group; and $A^1$, $A^2$, $B^1$ when m is 1 to 4, and $B^2$ when n is 1 to 4 each independently represent a sulfonic acid ester group, a carboxylic acid amido group, or a sulfonic acid amido group, or ii) in Formula (1), L represents a straight chain alkylene group having 1 to 12 carbon atoms or a branched alkylene group having 1 to 12 carbon atoms; and $A^1$, $A^2$, $B^1$ when m is 1 to 4, and $B^2$ when n is 1 to 4 each independently represent a carboxylic acid amido group.

Formula (1) shows the coloring compound in its azo form, and the tautomer thereof, a hydrazo form, is also included in the scope of the present invention.

The coloring compound represented by Formula (1) used in the present invention can be synthesized in accordance with a known method, for example, described in International Publication No. WO2012/039361.

Examples of the compound represented by Formula (1) used in the present invention include, but not limited thereto, the following compounds (1) to (33).

[Chem. 3]

Compound (1)

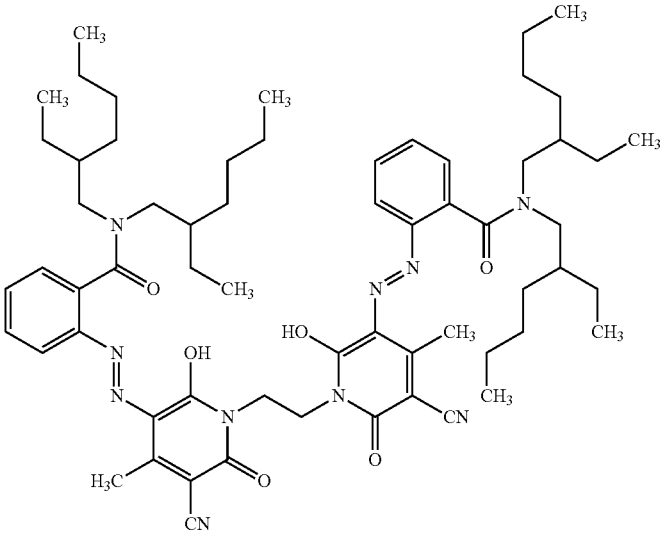

Compound (2)

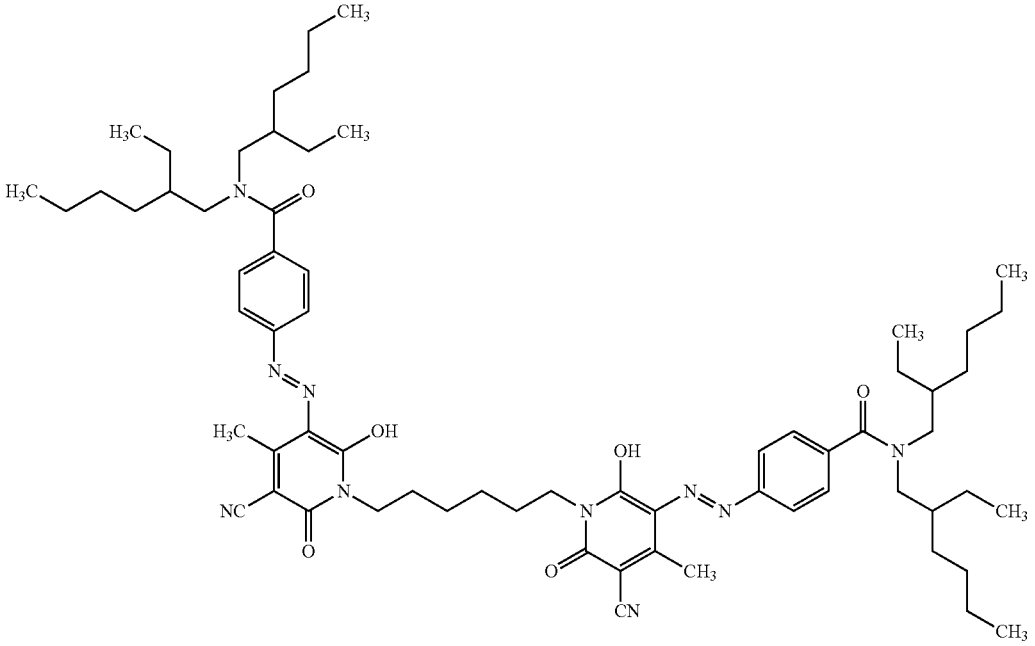

-continued
Compound (3)
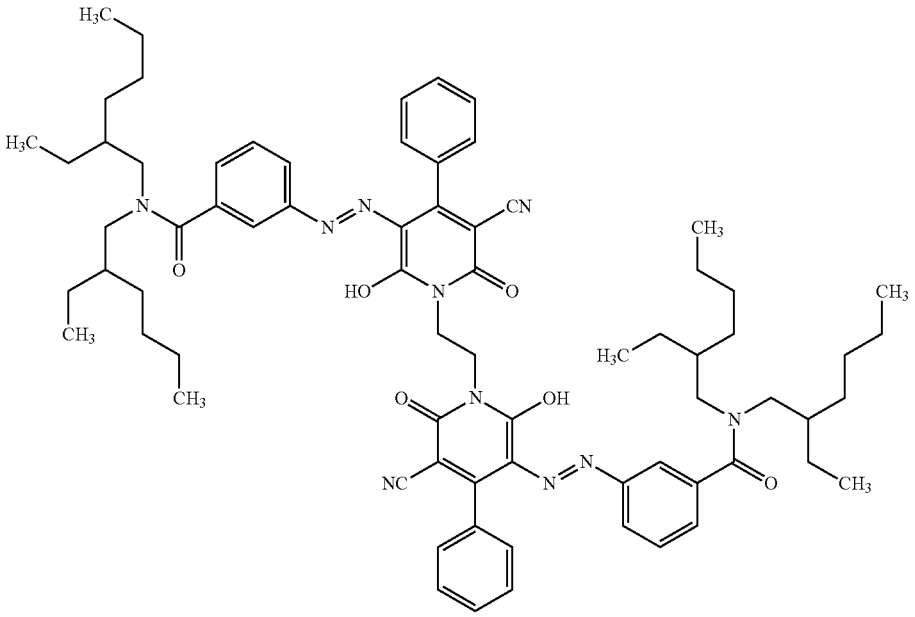
Compound (4)
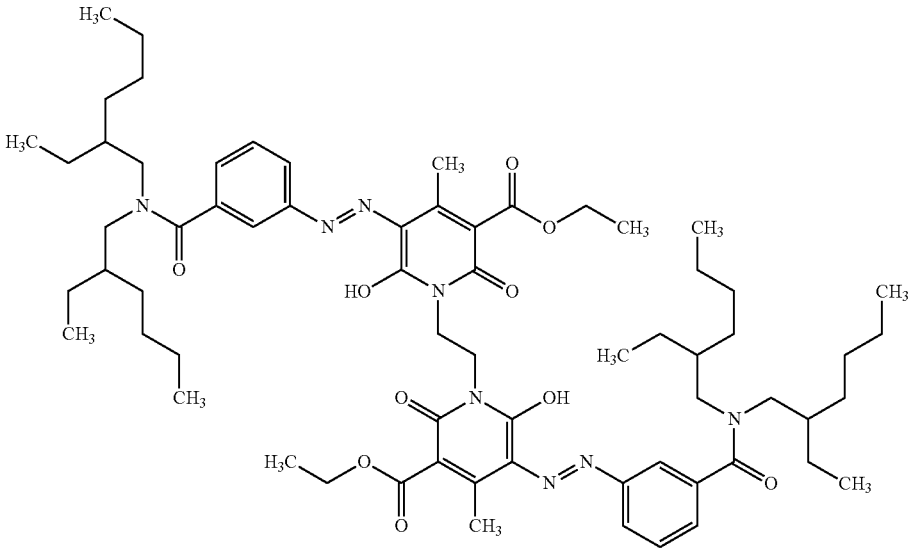

-continued
Compound (5)
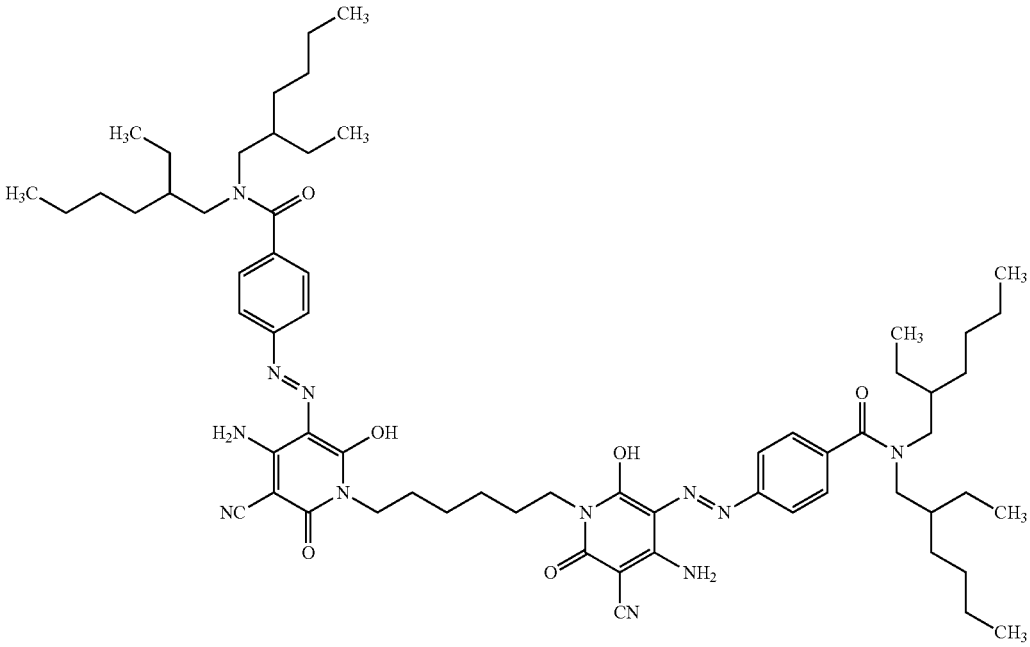
Compound (6)
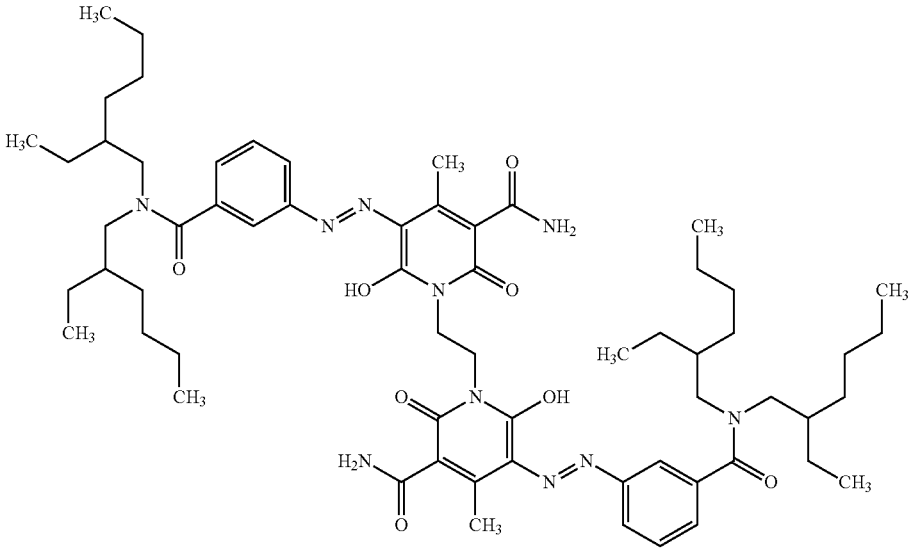
[Chem. 4]
Compound (7)
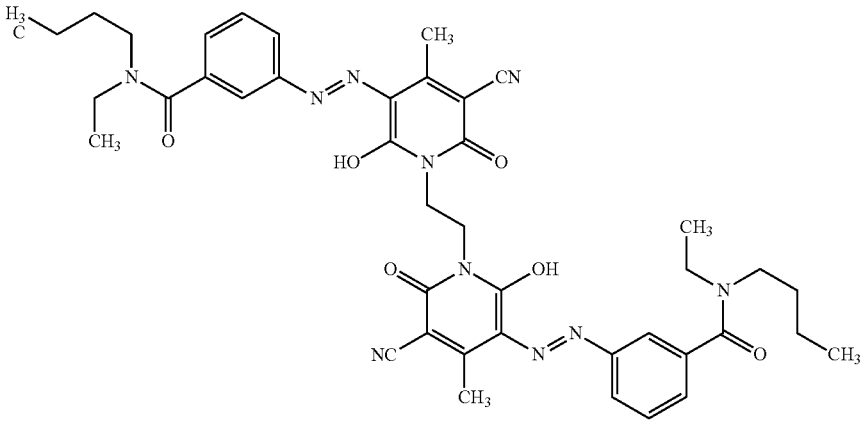

-continued
Compound (8)
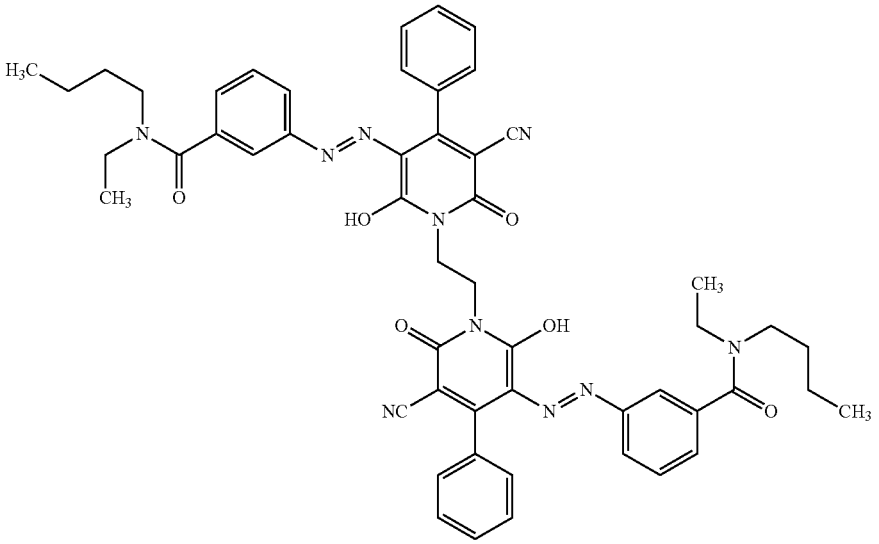
Compound (9)
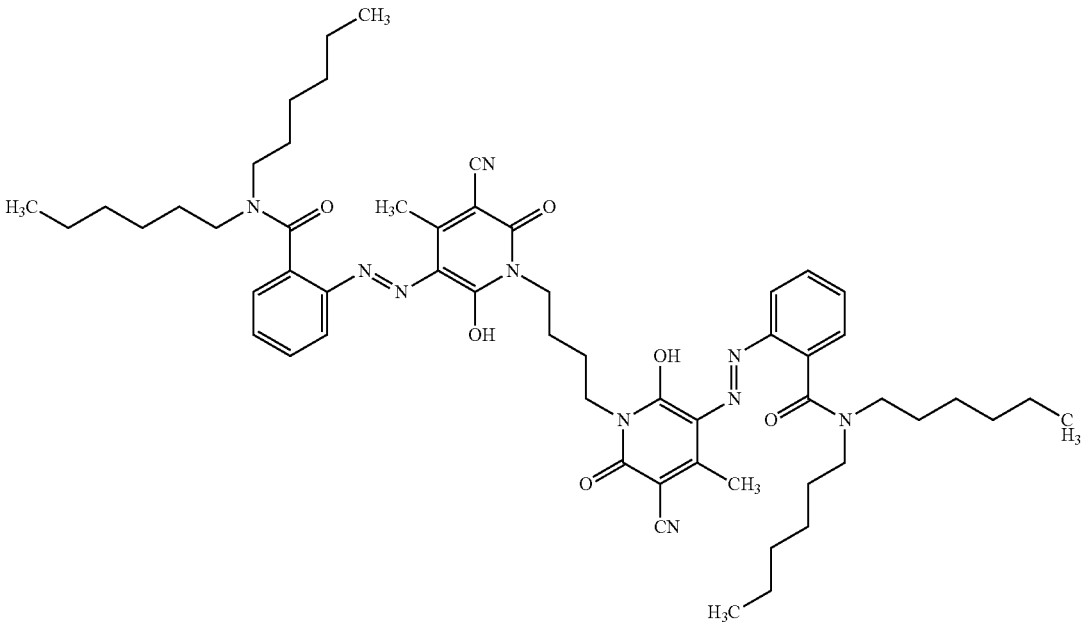

-continued
Compound (10)
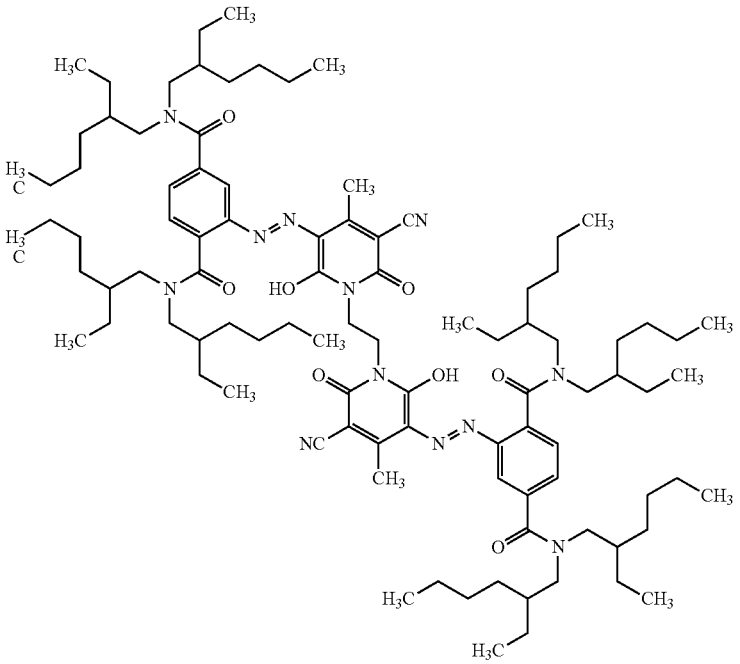
Compound (11)
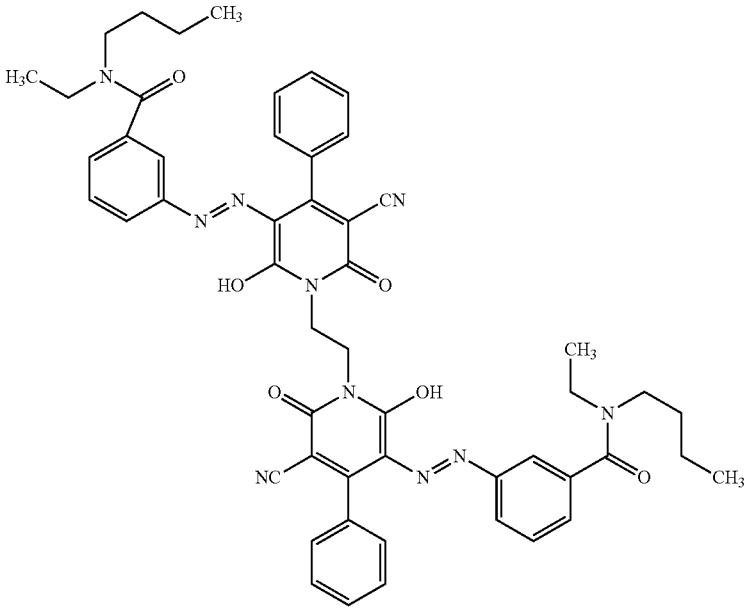

-continued
Compound (12)
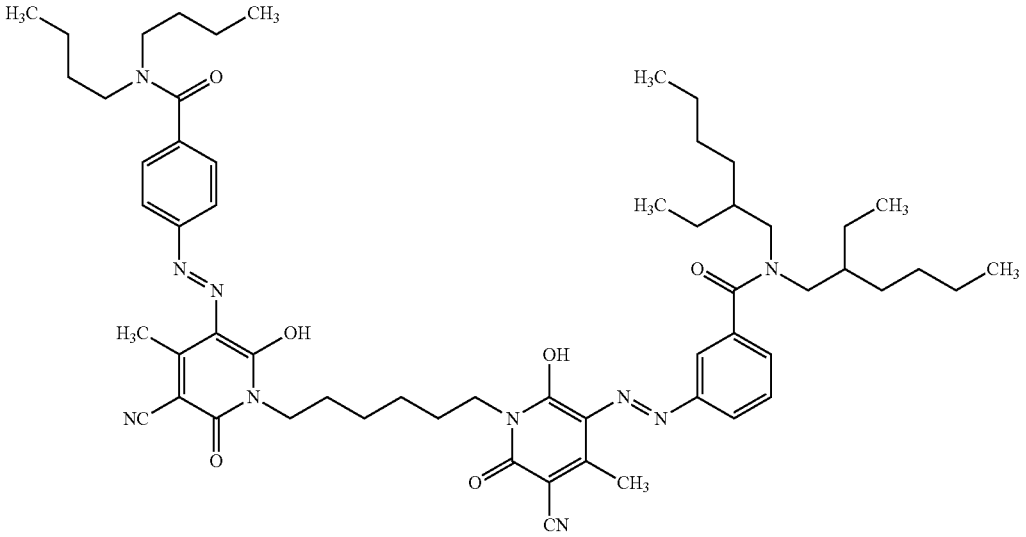
[Chem. 5]
Compound (13)
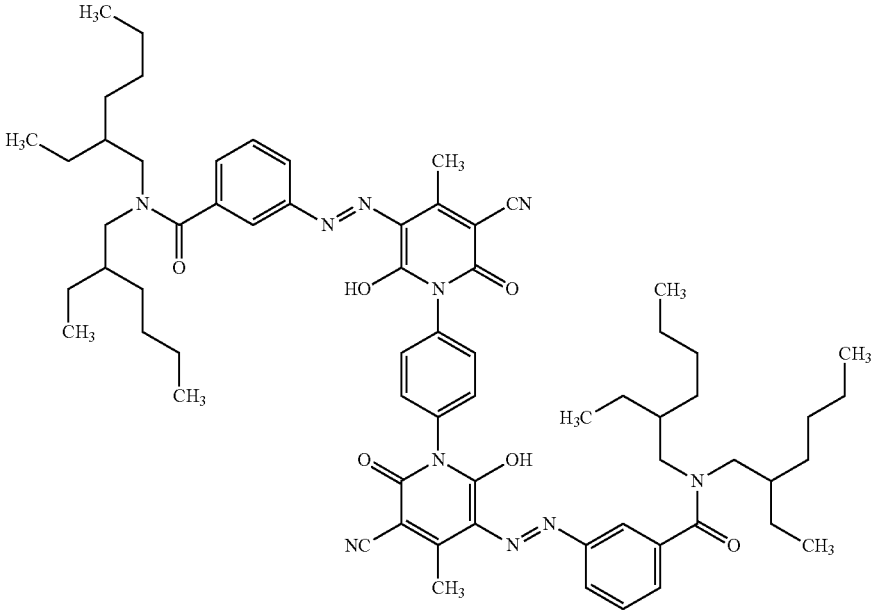

-continued
Compound (14)
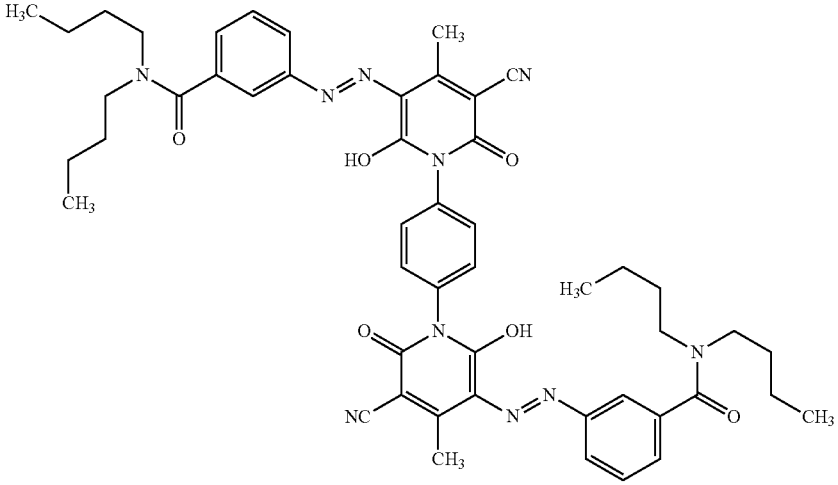
Compound (15)
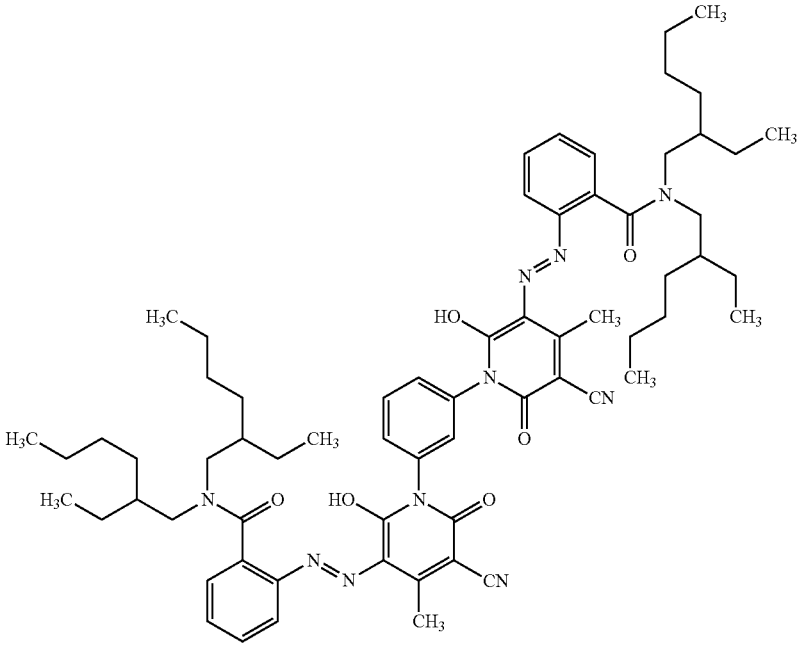
Compound (16)
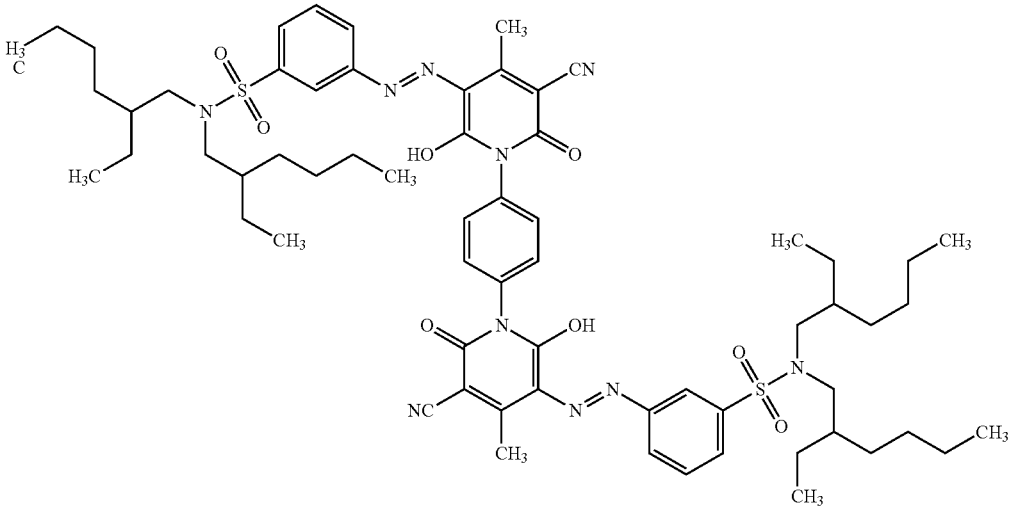

-continued
Compound (17)
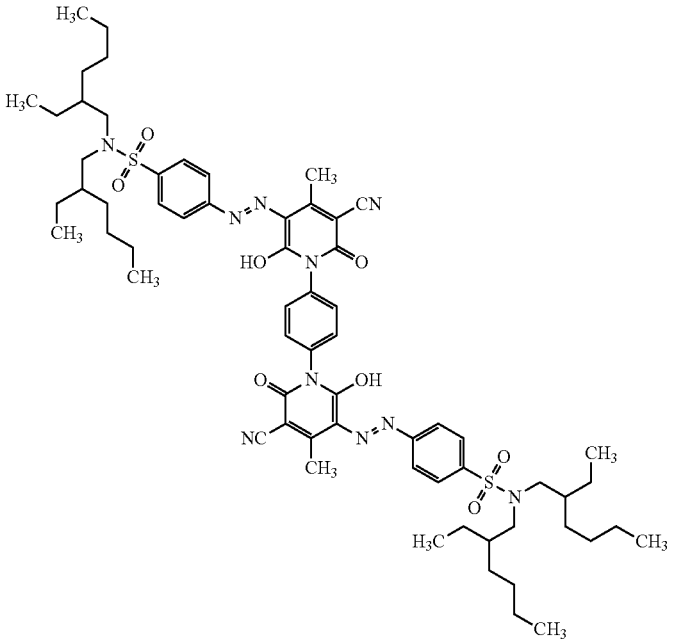
Compound (18)
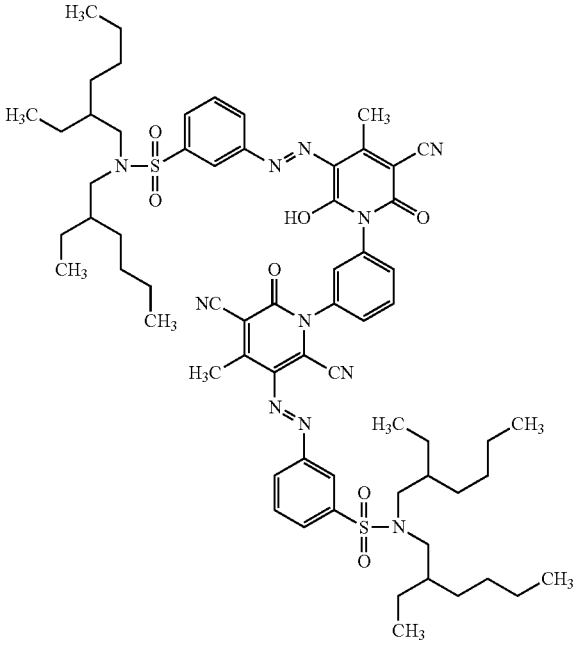

-continued
[Chem. 6]
Compound (19)
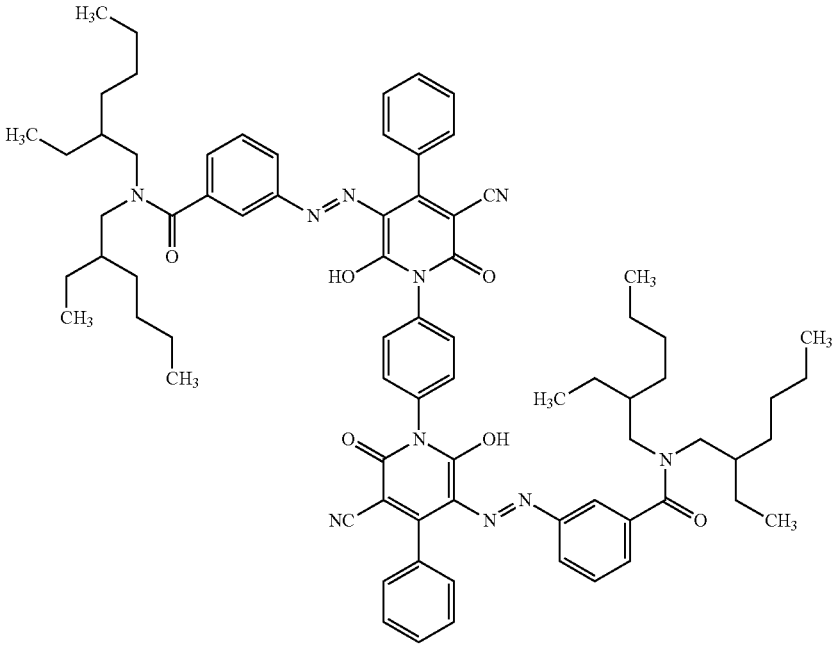
Compound (20)
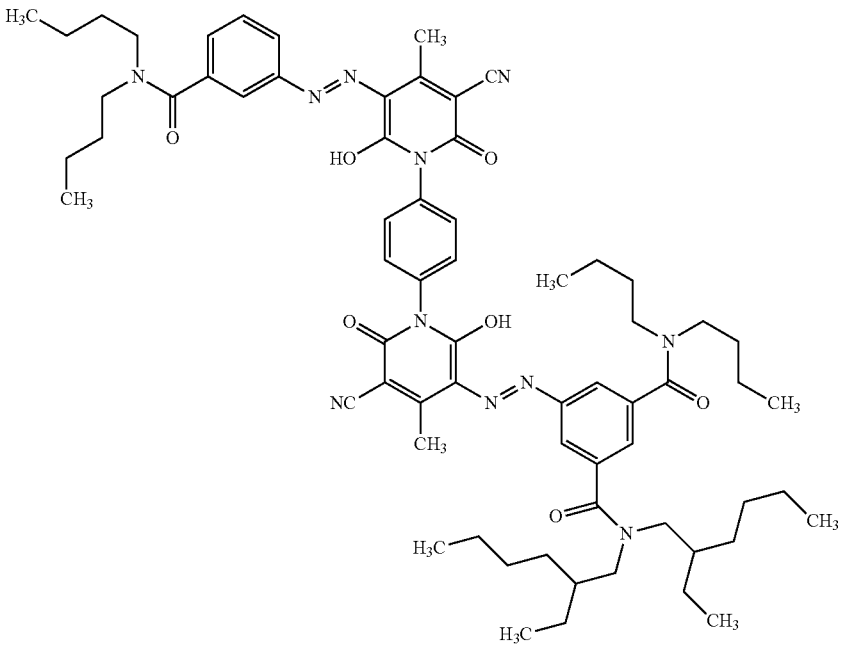

-continued
Compound (21)
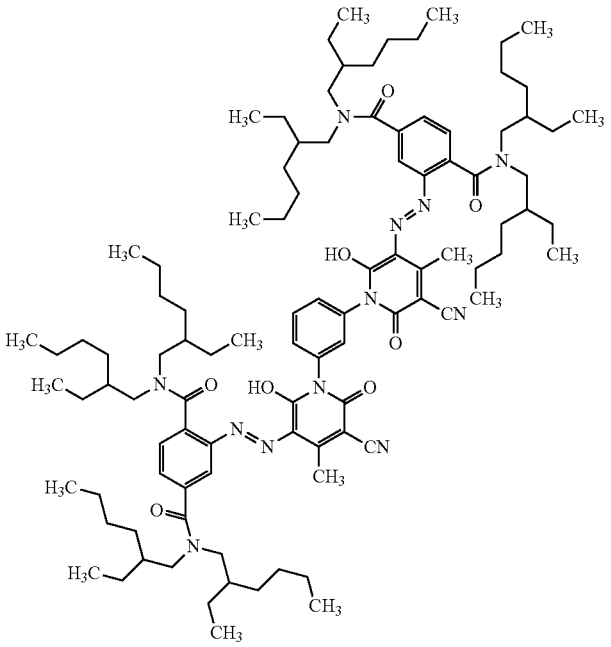
Compound (22)
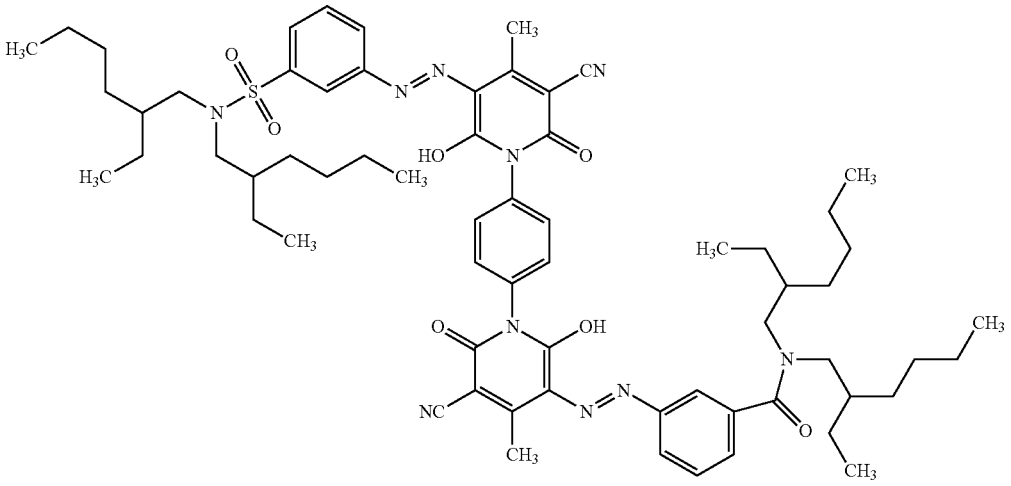

-continued
Compound (23)
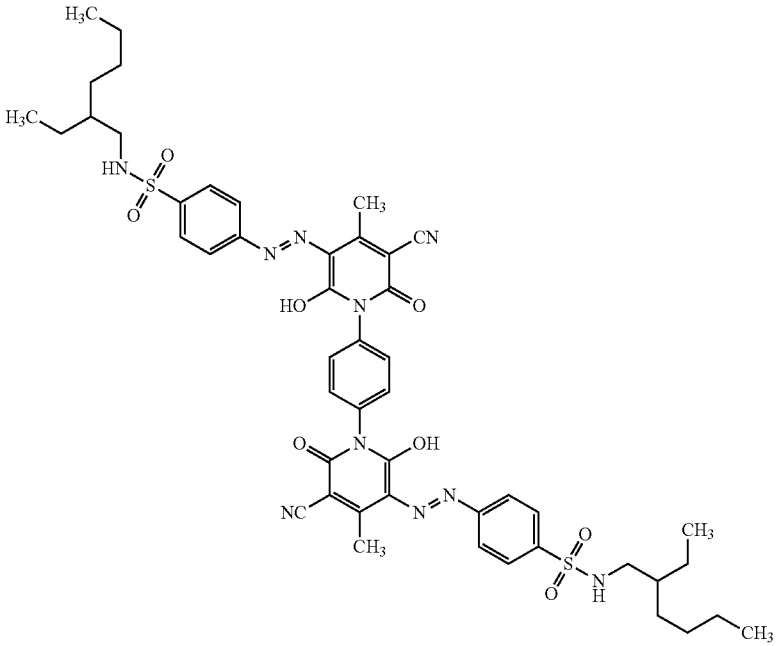
Compound (24)
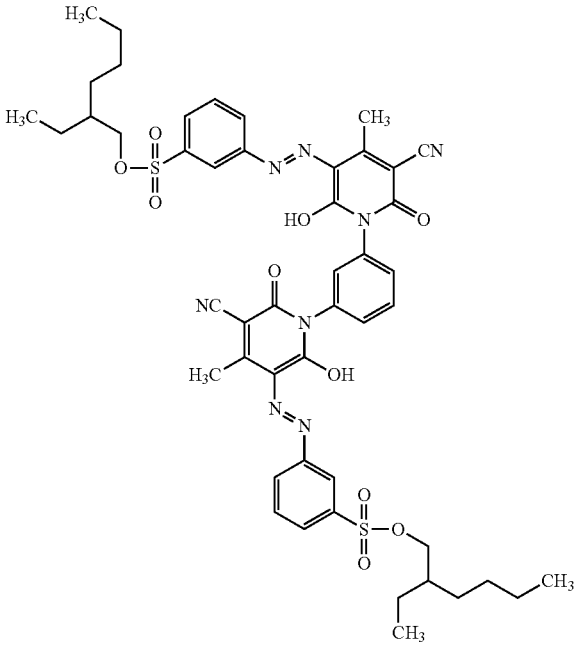

-continued
[Chem. 7]
Compound (25)
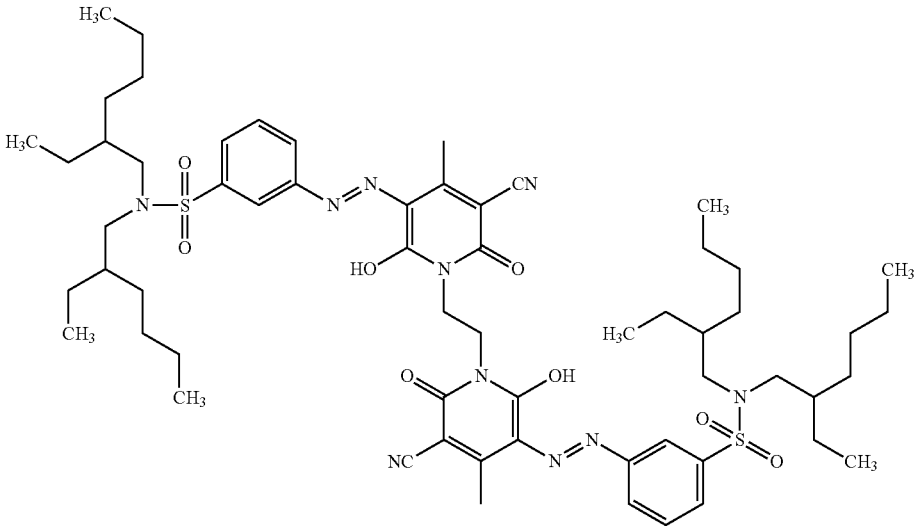
Compound (26)
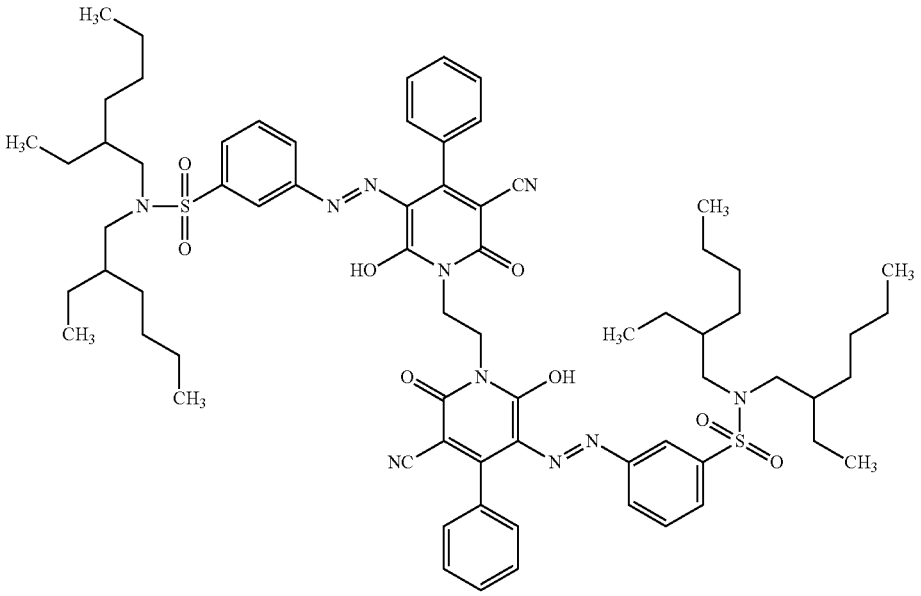

-continued
Compound (27)
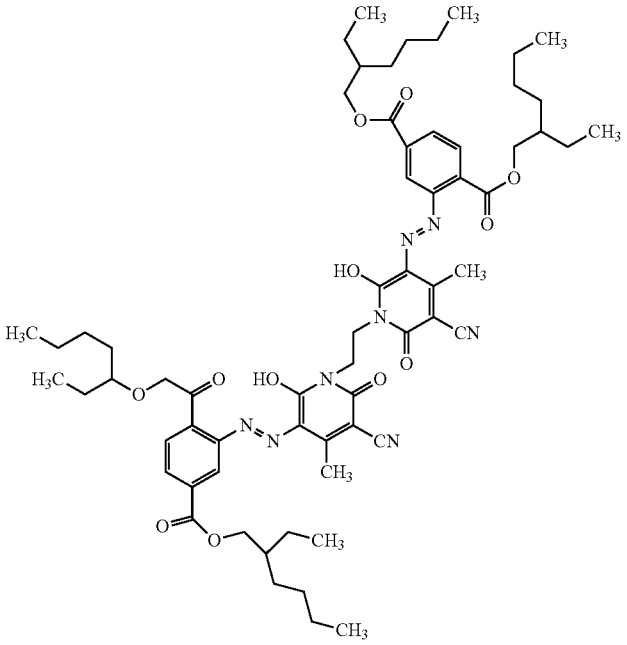
Compound (28)
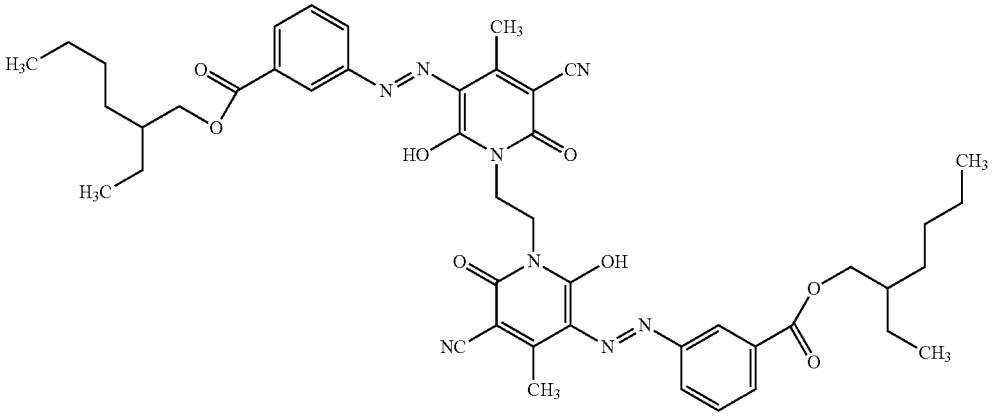

-continued
Compound (29)
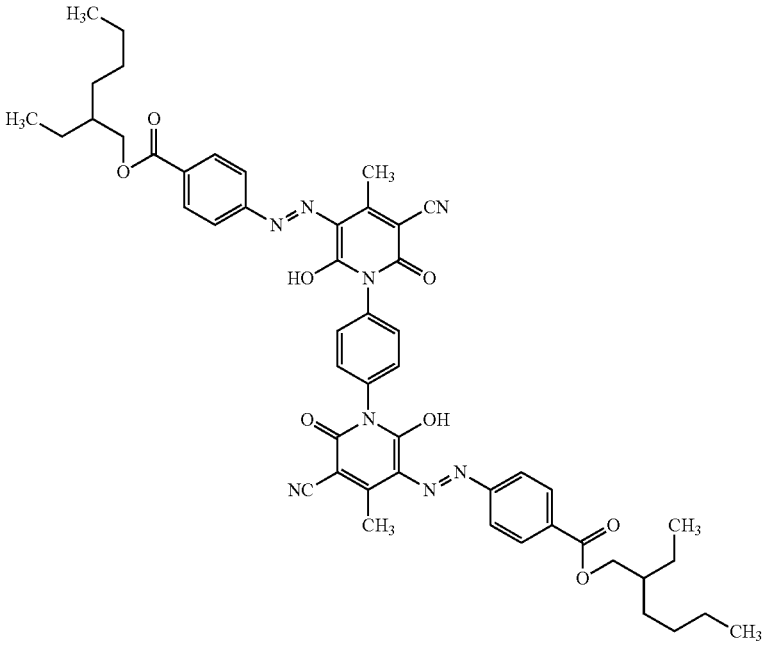
Compound (30)
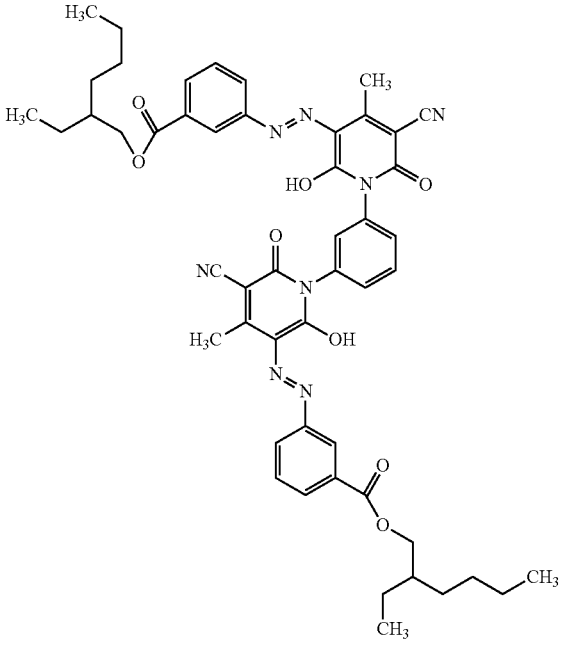

-continued
[Chem. 8]
Compound (31)
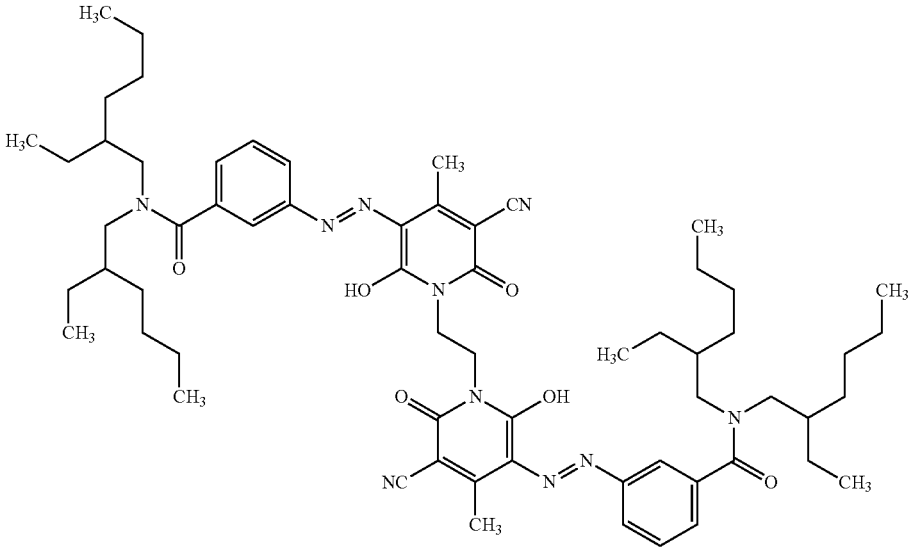
Compound (32)
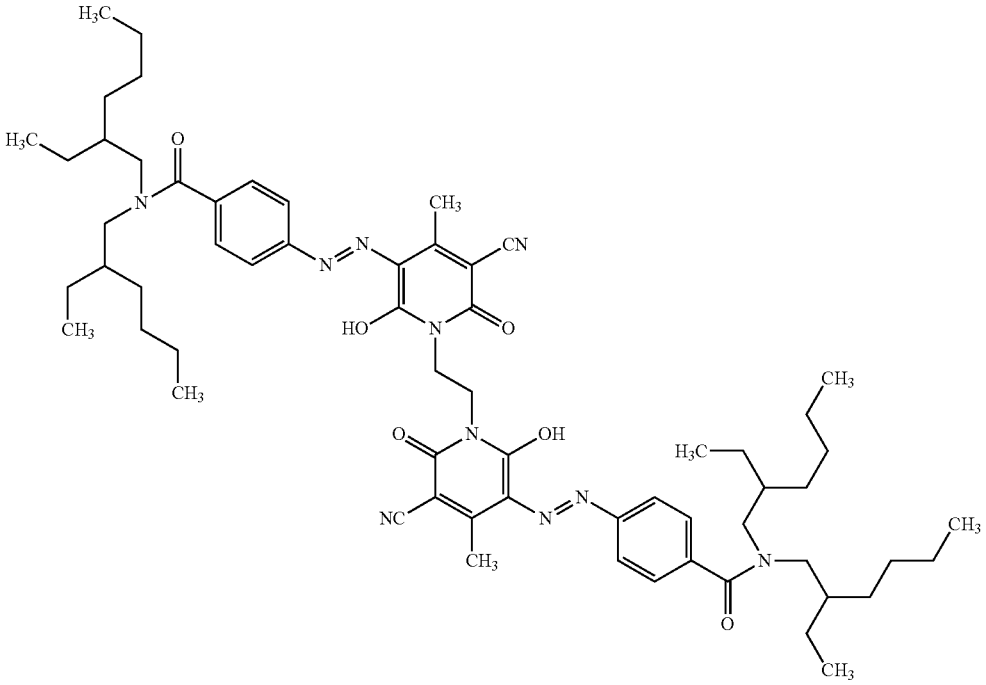

-continued
Compound (33)
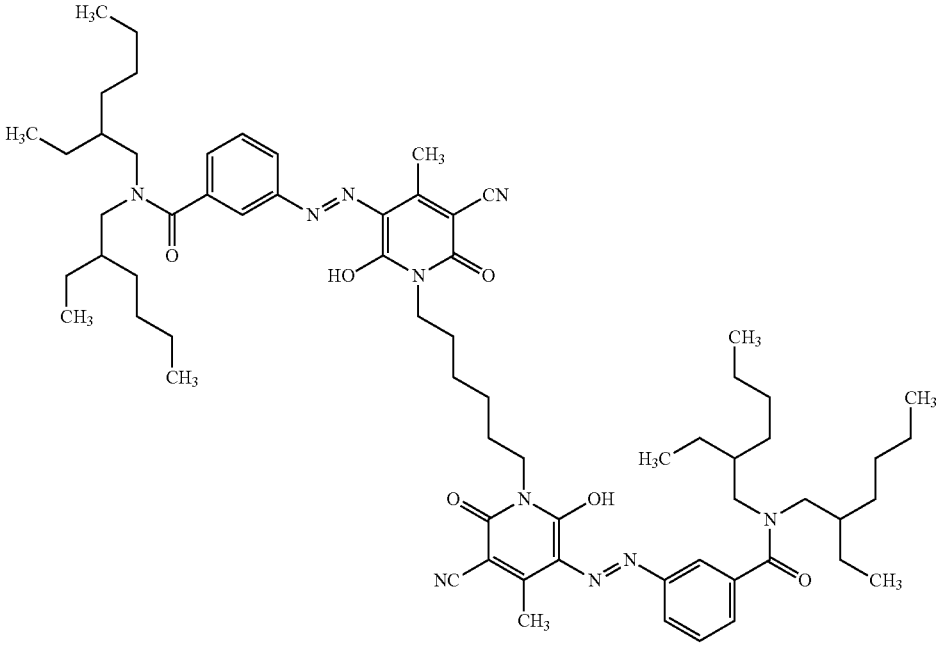
Compound (34)
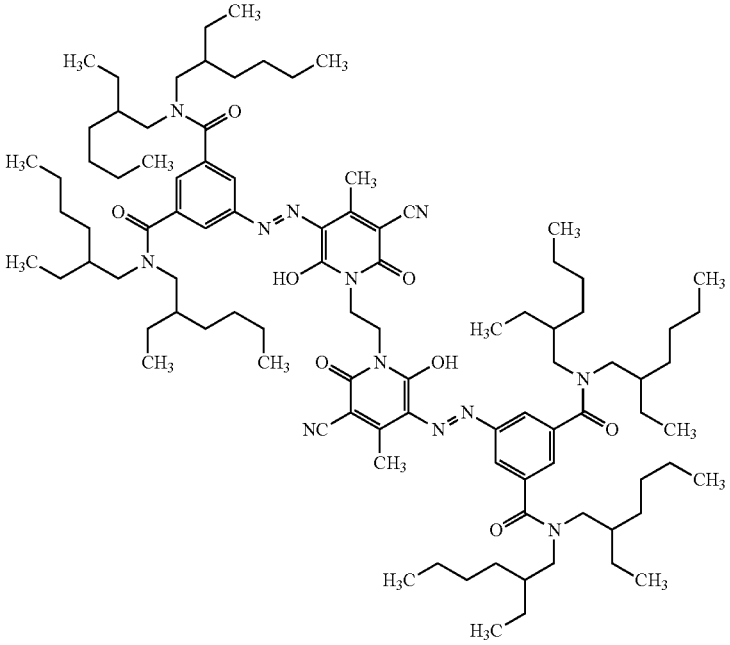

-continued
Compound (35)
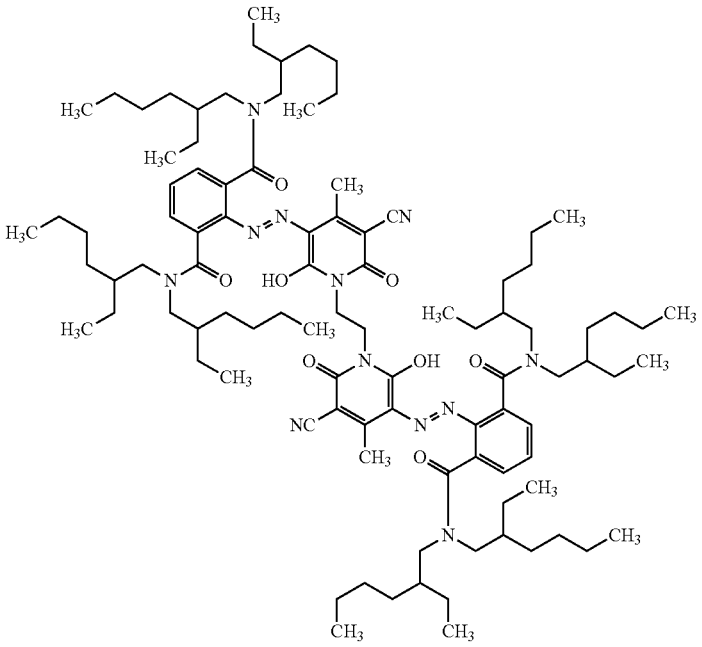
Compound (36)
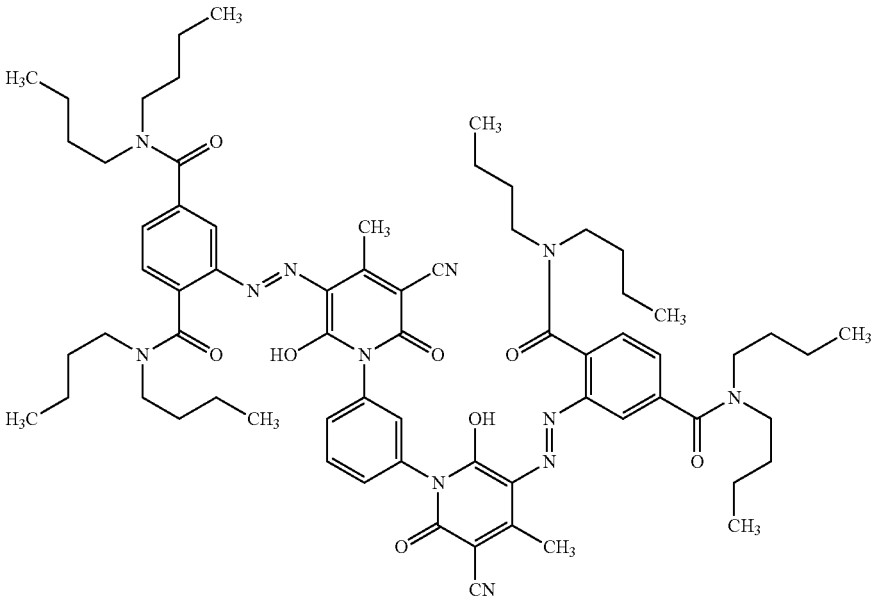

-continued
Compound (37)
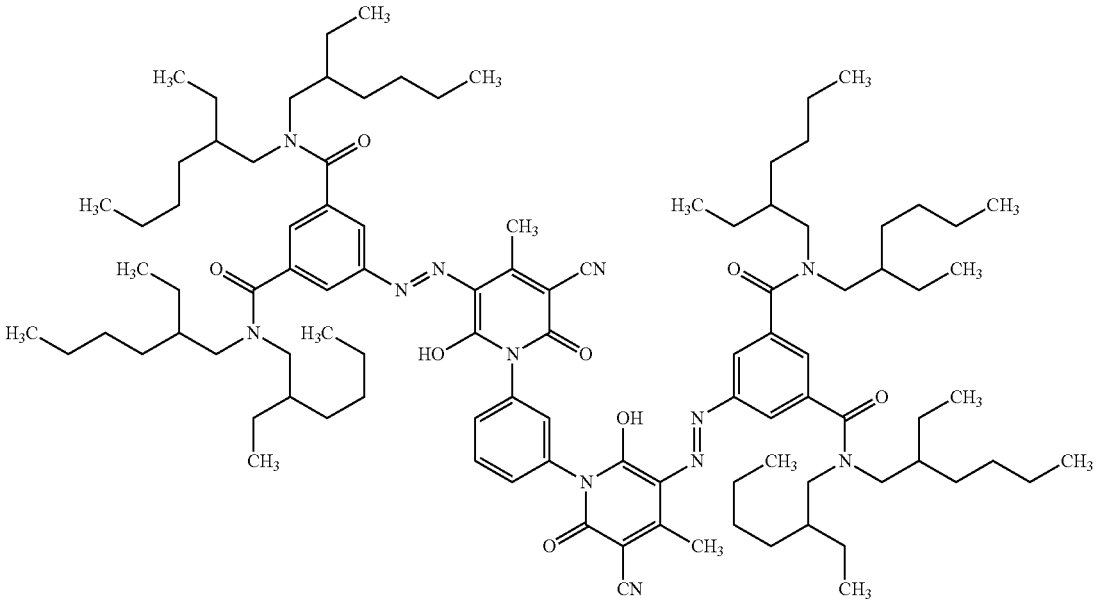
Compound (38)
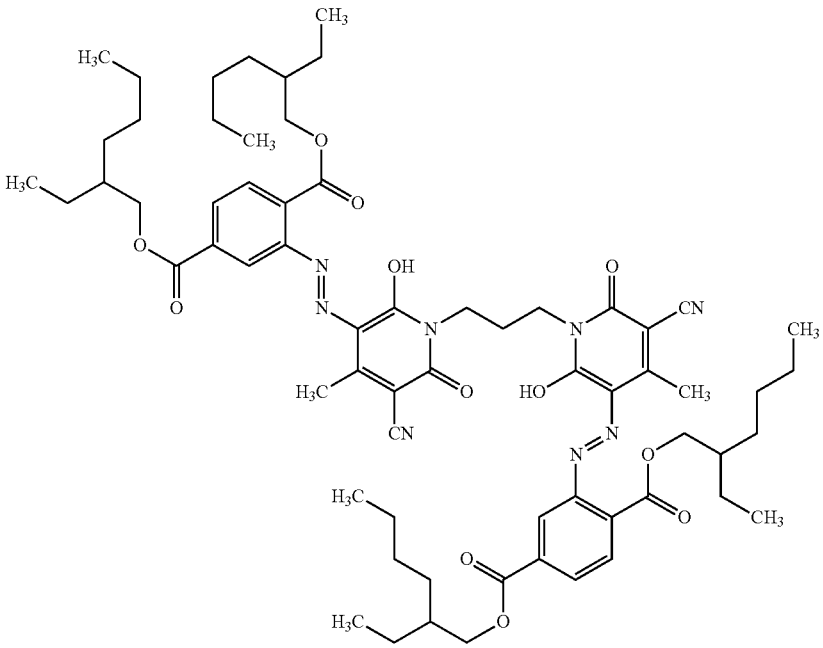

-continued
Compound (39)
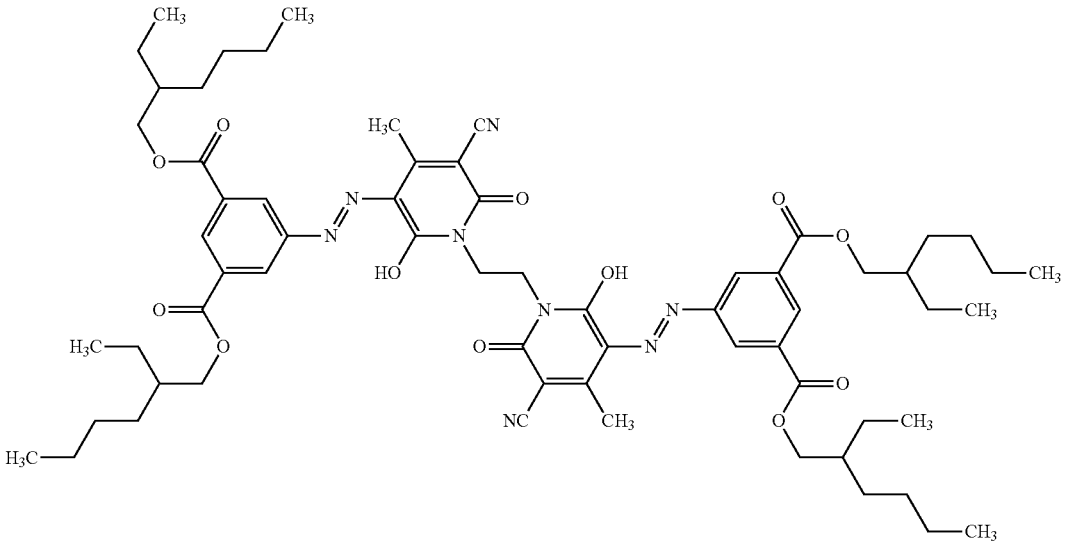
Compound (40)
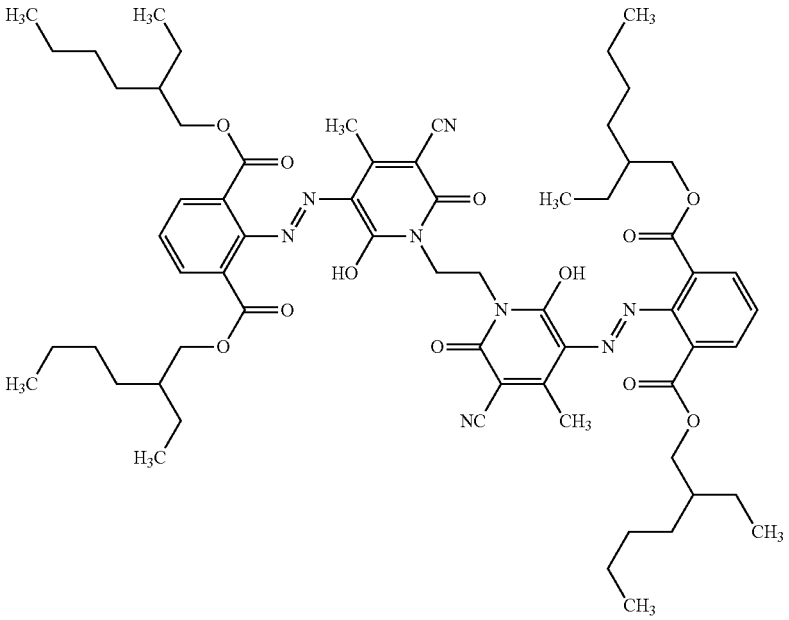

-continued

Compound (41)

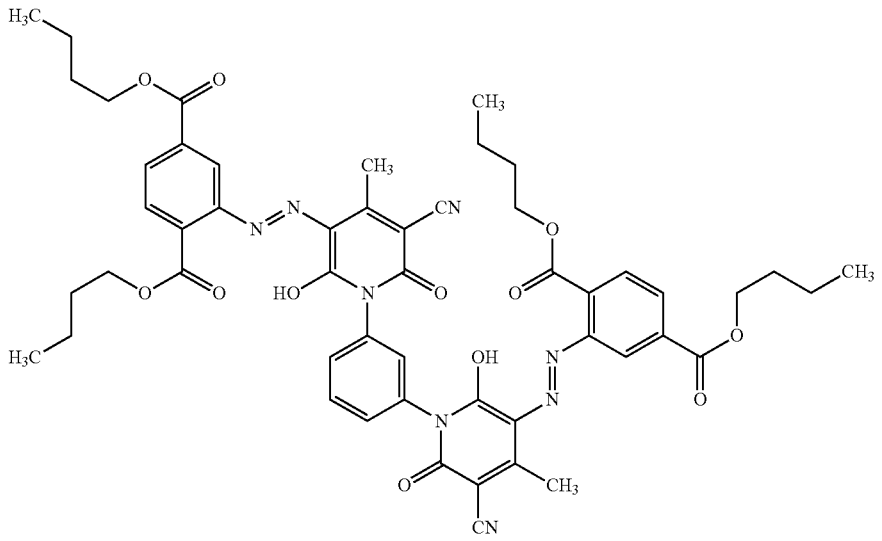

Toner

The coloring compound represented by Formula (1) used in the present invention has high compatibility to a binder resin and is uniformly dissolved in the binder resin during the process of producing a toner. Accordingly, a toner containing the binder resin and the coloring compound represented by Formula (1) of the present invention can be excellent in both saturation and light resistance.

The content of the coloring compound represented by Formula (1) can be 1 to 20 parts by mass based on 100 parts by mass of the binder resin.

The toner of the present invention may contain a plurality of the coloring compounds represented by Formula (1) having different structures or a combination of the coloring compound and a known dye or pigment in order to adjust the color tone.

The pigment used in the combination can be, for example, C.I. Pigment Yellow 185, C.I. Pigment Yellow 180, or C.I. Pigment Yellow 155.

Binder Resin

The binder resin used in the present invention is not particularly limited, and, for example, thermoplastic resins can be used.

Examples of the binder resin include vinyl resins that are homopolymers or copolymers of the following polymerizable monomers. Examples of the polymerizable monomer include styrene and styrene derivatives such as styrene, p-chlorostyrene, and α-methylstyrene; acrylic esters such as methyl acrylate, ethyl acrylate, n-propyl acrylate, n-butyl acrylate, lauryl acrylate, and 2-ethylhexyl acrylate; methacrylic esters such as methyl methacrylate, ethyl methacrylate, n-propyl methacrylate, lauryl methacrylate, and 2-ethylhexyl methacrylate; vinyl nitriles such as acrylonitrile and methacrylonitrile; vinyl ethers such as vinyl ethyl ether and vinyl isobutyl ether; ketones such as vinyl methyl ketone, vinyl ethyl ketone, and vinyl isopropenyl ketone; and olefins such as ethylene, propylene, butadiene, and isoprene.

In addition, examples of the resin other than the vinyl resins include non-vinyl condensation resins such as epoxy resins, polyester resins, polyurethane resins, polyamide resins, cellulose resins, and polyether resins; and graft polymers of these non-vinyl condensation resins and vinyl monomers. These resins may be used alone or in combination of two or more thereof.

In addition, a polyester resin can be also used as a resin for a toner. Examples of the acid component used in synthesis of the polyester resin include oxalic acid, malonic acid, succinic acid, glutaric acid, adipic acid, pimelic acid, suberic acid, azelaic acid, sebacic acid, 1,9-nonane dicarboxylic acid, 1,10-decane dicarboxylic acid, 1,11-undecane dicarboxylic acid, 1,12-dodecane dicarboxylic acid, 1,13-tridecane dicarboxylic acid, 1,14-tetradecane dicarboxylic acid, 1,16-hexadecane dicarboxylic acid, and 1,18-octadecane dicarboxylic acid, and lower alkyl esters and anhydrides thereof. In particular, the acid component can be an aliphatic dicarboxylic acid, specifically, an aliphatic dicarboxylic acid having saturated carboxylic acid as the aliphatic moiety. Examples of the alcohol component used in synthesis of the polyester resin include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol, and 1,20-eicosanediol.

Any polyester resin having a molar ratio of alcohol component/acid component in a range of 45/55 to 55/45 can be used.

In polyester resins, an increase in number of the terminal groups of the molecular chain tends to increase the dependence of the charging characteristics of the toner on the environment. Accordingly, the polyester resin preferably has an acid value of 90 mg KOH/g or less and more preferably 50 mg KOH/g or less and has a hydroxyl value of 50 mg KOH/g or less and more preferably 30 mg KOH/g or less. The acid value, however, should be 3 mg KOH/g or more in light of the frictional electrification characteristics of the toner.

In the present invention, the binder resin may be synthesized using a crosslinking agent in order to increase the mechanical strength of the toner and also control the molecular weight of the toner molecule.

The crosslinking agent can be a bifunctional crosslinking agent, and examples thereof include divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400, and #600, dipropylene glycol diacrylate, polypropylene glycol diacrylate, polyester-type diacrylates, and dimethacrylates corresponding to these diacrylates.

The crosslinking agent can be a multifunctional crosslinking agent, and examples thereof include pentaerythritol triacrylate, trimethylolethane triacrylate, trimethylolpropane triacrylate, tetramethylolmethane tetraacrylate, oligoester acrylate, and methacrylates corresponding to these acrylates, 2,2-bis(4-methacryloxyphenyl)propane, diallyl phthalate, triallyl cyanurate, triallyl isocyanurate, and triallyl trimellitate.

The amount of such a crosslinking agent is preferably 0.05 to 10 parts by mass and more preferably 0.1 to 5 parts by mass based on 100 parts by mass of the polymerizable monomer used for preparing the binder resin.

The binder resin preferably has a glass transition temperature of 45° C. to 80° C. and more preferably 55° C. to 70° C., a number-average molecular weight (Mn) of 2500 to 50000, and a weight-average molecular weight (Mw) of 10000 to 1000000.

Wax

The toner of the present invention can contain a wax.

The wax is a material that is used for preventing offset during toner fixation. The wax used in the present invention is not particularly limited, and examples thereof include petroleum waxes such as paraffin wax, microcrystalline wax, and petrolatum, and derivatives thereof; montan waxes and derivatives thereof; hydrocarbon waxes produced by a Fischer-Tropsch process and derivatives thereof; polyolefin waxes such as polyethylene and derivatives thereof; and natural waxes such as carnauba waxes and candelilla wax and derivatives thereof. The derivatives include oxides, block copolymers with vinyl monomers, and graft-modified products. Moreover, examples of the wax include alcohols such as higher aliphatic alcohols, aliphatic acids such as stearic acid and palmitic acid and compounds thereof, acid amides, esters, ketones, hydrogenated castor oil and derivatives thereof, plant waxes, and animal waxes. These waxes can be used alone or in combination.

The amount of the wax is preferably in a range of 2.5 to 15.0 parts by mass and more preferably 3.0 to 10.0 parts by mass based on 100 parts by mass of the binder resin. The wax in an amount controlled within this range allows oilless fixing to be readily achieved with less influence on charging characteristics.

The wax used in the present invention preferably has a melting point of 50° C. or more and 200° C. or less and more preferably 55° C. or more and 150° C. or less. A wax having a melting point of 50° C. or more and 200° C. or less can improve the blocking resistance of the toner, the exudation properties of the wax during fixation, and also the releasing properties in oilless fixation.

The melting point in the present invention refers to the endothermic peak temperature of a subject in a differential scanning calorimetry (DSC) curve measured in accordance with ASTM D3418-82. Specifically, the melting point of a wax is the endothermic peak temperature of a subject in a DSC curve obtained in a temperature range of 30° C. to 200° C. in the second temperature-increasing process under ordinary temperature and ordinary humidity environment at a rate of temperature increase of 5° C./min in a measurement temperature range of 30° C. to 200° C. with a differential scanning calorimeter (DSC822, manufactured by Mettler Toledo International Inc.).

Other Toner Constituent Materials

The toner of the present invention optionally contains a charge controlling agent.

The charge controlling agent may be a known one. In particular, a charge controlling agent showing a high charging speed and stably maintaining a certain charge amount can be used. In the production of a toner by direct polymerization, in particular, a charge controlling agent having low polymerization inhibiting properties and substantially not including a material soluble in an aqueous dispersion medium can be used.

The charge controlling agent can be an agent that controls a toner to a negative charge, and examples thereof include polymers or copolymers having sulfonate groups, sulfonate bases, or alkoxysulfonyl groups; salicylic acid derivatives and metal complexes thereof; monoazo metal compounds; acetylacetone metal compounds; aromatic oxycarboxylic acids and aromatic mono or polycarboxylic acids, and metal salts, anhydrides, and esters thereof; phenol derivatives such as bisphenol; urea derivatives; metal-containing naphthoic acid compounds; boron compounds; quaternary ammonium salts; calixarenes; and resin charge controlling agents.

The charge controlling agent can be an agent that controls a toner to a positive charge, and examples thereof include nigrosine and fatty acid metal salt-modified nigrosine; guanidine compounds; imidazole compounds; quaternary ammonium salts, such as tributylbenzylammonium-1-hydroxy-4-naphthosulfonate and tetrabutylammonium tetrafluoroborate, and analogs thereof, such as onium salts (e.g., phosphonium salts), and lake pigments thereof; triphenylmethane dyes and lake pigments thereof (laking agents: phosphorus tungstic acid, phosphorus molybdenic acid, phosphorus tungsten molybdenic acid, tannic acid, lauric acid, gallic acid, ferricyanide products, and ferrocyanide products); metal salts of higher fatty acids; diorganotin oxides such as dibutyltin oxide, dioctyltin oxide, and dicyclohexyltin oxide; diorganotin borates such as dibutyltin borate, dioctyltin borate, and dicyclohexyltin borate; and resin charge controlling agents. These charge controlling agents may be used or in combination of two or more thereof.

The toner of the present invention may include externally added inorganic fine powder or resin particles. Examples of the inorganic fine powder include silica, titanium oxide, alumina, multiple oxides thereof, and surface-treated fine powders thereof. Examples of the resin of the resin particles include vinyl resins, polyester resins, and silicone resins. These inorganic fine powder and resin particles are external additives having functions as flowability aids and cleaning aids.

Physical Properties of Toner

The toner of the present invention preferably has a weight-average particle diameter (D4) of 4.0 to 9.0 μm and more preferably 4.9 to 7.5 μm. A toner having a weight-average particle diameter (D4) within this range has enhanced electrification stability and further inhibits occurrence of image fogs and development lines even in continuous image development operation of a large number of sheets (duration operation). The reproducibility of a halftone portion is also improved.

In the toner of the present invention, the ratio of the weight-average particle diameter (D4) to the number-average particle diameter (D1) (hereinafter, also referred to as weight-average particle diameter (D4)/number-average particle diameter (D1) or D4/D1) is preferably 1.35 or less and more preferably 1.30 or less. A toner satisfying this relationship shows enhanced inhibition of fog occurrence and improved transferability and also produces a more uniform line width.

The weight-average particle diameter (D4) and the number-average particle diameter (D1) of the toner of the present invention are adjusted by different methods depending on the method of producing the toner particles. For example, in a case of suspension polymerization, these particle diameters can be adjusted by controlling, for example, the dispersant concentration and the reaction stirring rate or the reaction stirring time in the preparation of the aqueous dispersion medium.

The toner of the present invention preferably has an average circularity of 0.930 or more and 0.995 or less and more preferably 0.960 or more and 0.990 or less when measured with a flow particle image analyzer. Such a toner has remarkably improved transferability.

Method of Producing Toner

Methods of producing the toner particles will now be described, but the present invention is not limited to these methods.

Examples of the process of producing toner particles of the present invention include a pulverization process, a suspension polymerization process, a suspension granulation process, an emulsion polymerization process, an emulsion aggregation process, a dissolution suspension process, and an ester extension polymerization process.

Production of Toner Particles by Suspension Polymerization

Production of toner particles by suspension polymerization will be described.

In suspension polymerization, a polymerizable monomer composition containing a colorant, a polymerizable monomer, and a polymerization initiator and optionally a resin and a wax is added to an aqueous medium, and toner particles are produced through a step of granulating particles of the polymerizable monomer composition in the aqueous medium and a step of polymerizing the polymerizable monomer contained in the particles of the polymerizable monomer composition. The polymerization initiator is not necessarily contained in the polymerizable monomer composition and may be added to the composition during or after the granulation.

The polymerizable monomer composition in this method of producing a toner can be prepared by dispersing the colorant in a first polymerizable monomer and then mixing the resulting dye dispersion with a second polymerizable monomer. That is, a colorant can be further well-dispersed in toner particles by sufficiently dispersing the colorant in a first polymerizable monomer and then mixing the resulting dispersion with a second polymerizable monomer together with other toner materials. The first polymerizable monomer and the second polymerizable monomer may be the same or different.

Examples of the polymerizable monomer include styrene monomers such as styrene, o-methylstyrene, m-methylstyrene, p-methylstyrene, o-ethylstyrene, m-ethylstyrene, and p-ethylstyrene; acrylic monomers such as methyl acrylate, ethyl acrylate, propyl acrylate, butyl acrylate, octyl acrylate, dodecyl acrylate, stearyl acrylate, behenyl acrylate, 2-ethylhexyl acrylate, dimethylaminoethyl acrylate, diethylaminoethyl acrylate, acrylonitrile, and amide acrylate; methacrylic monomers such as methyl methacrylate, ethyl methacrylate, propyl methacrylate, butyl methacrylate, octyl methacrylate, dodecyl methacrylate, stearyl methacrylate, behenyl methacrylate, 2-ethylhexyl methacrylate, dimethylaminoethyl methacrylate, diethylaminoethyl methacrylate, methacrylonitrile, and amide methacrylate; olefin monomers such as ethylene, propylene, butylene, butadiene, isoprene, isobutylene, and cyclohexene; halogenated vinyls such as vinyl chloride, vinylidene chloride, vinyl bromide, and vinyl iodide; vinyl esters such as vinyl acetate, vinyl propionate, and vinyl benzoate; vinyl ethers such as vinyl methyl ether, vinyl ethyl ether, and vinyl isobutyl ether; and vinyl ketone compounds such as vinyl methyl ketone, vinyl hexyl ketone, and methyl isopropenyl ketone. These monomers can be used alone or in combination of two or more thereof, depending on the use. In particular, styrenes, acrylic monomers, and methacrylic monomers can be used alone or in combination.

Usable examples of the resin include polystyrene resins, polyacrylic acid resins, polymethacrylic acid resins, polyacrylic acid ester resins, polymethacrylic acid ester resins, styrene acrylic copolymers (e.g., styrene-acrylic acid ester copolymers, styrene-methacrylic acid ester copolymers, and styrene-acrylic acid ester-methacrylic acid ester copolymers), polyester resins, polyvinyl ether resins, polyvinyl methyl ether resins, polyvinyl alcohol resins, and polyvinyl butyral resins. These resins can be used alone or in combination of two or more thereof.

The polymerization initiator used in the suspension polymerization can be a known polymerization initiator. Examples of the polymerization initiator include azo compounds, organic peroxides, inorganic peroxides, organic metal compounds, and photopolymerization initiators, and more specifically, azo polymerization initiators such as 2,2'-azobis(isobutyronitrile), 2,2'-azobis(2-methylbutyronitrile), 2,2'-azobis(4-methoxy-2,4-dimethylvaleronitrile), 2,2'-azobis(2,4-dimethylvaleronitrile), and dimethyl-2,2'-azobis(isobutylate); organic peroxide polymerization initiators such as benzoyl peroxide, di-tert-butyl peroxide, tert-butylperoxyisopropyl monocarbonate, tert-hexylperoxybenzoate, and tert-butylperxoybenzoate; inorganic peroxide polymerization initiators such as potassium persulfate and ammonium persulfate; and redox initiators such as hydrogen peroxide-ferrous, BPO-dimethylaniline, and cerium(IV) salt-alcohol redox initiators. Examples of the photopolymerization initiator include acetophenone, benzoin methyl ether, and benzoin methyl ketal. These methods may be employed alone or in combination of two or more thereof.

The amount of the polymerization initiator is preferably in a range of 0.1 to 20 parts by mass and more preferably 0.1 to 10 parts by mass based on 100 parts by mass of the polymerizable monomer. The usable type of the polymerization initiator slightly differs depending on the method of polymerization, and one or more polymerization initiators are selected using the 10-hour half-life period temperature as reference.

The aqueous medium used in the suspension polymerization can contain a dispersion stabilizing agent. The dispersion stabilizing agent may be a known inorganic or organic one. Examples of the inorganic dispersion stabilizing agent include calcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, and alumina. Examples of the organic dispersion stabilizing agent include polyvinyl alcohol, gelatin, methyl cellulose, methyl hydroxypropyl cellulose, ethyl cellulose, sodium salts of carboxymethyl cellulose, and starch. In addition, nonionic, anionic, and cationic surfactants can be used. Examples of the surfactant include sodium dodecylsulfate, sodium tetradecylsulfate, sodium pentadecylsulfate, sodium octylsulfate, sodium oleate, sodium laurate, potassium stearate, and calcium oleate.

In the present invention, in particular, the dispersion stabilizing agent can be an acid-soluble, water-insoluble inorganic dispersion stabilizing agent. In the present invention, in a case of preparing an aqueous dispersion medium with a water-insoluble inorganic dispersion stabilizing agent, the amount of the dispersion stabilizing agent should be in a range of 0.2 to 2.0 parts by mass based on 100 parts by mass of the polymerizable monomer, from the viewpoint of droplet stability of the polymerizable monomer composition in the aqueous medium. In the present invention, the aqueous medium can be prepared using water in a range of 300 to 3000 parts by mass based on 100 parts by mass of the polymerizable monomer composition.

Production of Toner Particles by Suspension Granulation

Production of toner particles by suspension granulation will be described.

The toner particles contained in the toner of the present invention may be produced by suspension granulation.

Since the suspension granulation does not include any heating step, even if a wax having a low melting point, compatibility between the wax and a resin hardly occurs to inhibit a reduction in glass transition temperature of a toner due to compatibility.

Furthermore, since the suspension granulation can use a binder resin selected from various toner material options, the use of a polyester resin, which is generally advantageous in fixity, as a main component is easy. Accordingly, the suspension granulation is advantageous in production of a toner having a resin composition that is hardly applicable to suspension polymerization.

For example, toner particles can be produced by suspension granulation as follows.

A solvent composition (dye dispersion) is prepared by mixing a colorant, a binder resin, and a wax in a solvent. Particles of the solvent composition are formed by dispersing the solvent composition in a liquid medium to give a toner particle suspension. The solvent is removed by heating the resulting suspension or reducing the inner pressure of the reaction container to give toner particles.

The solvent composition should be prepared by dispersing a colorant in a first solvent and further mixing the resulting dispersion and other toner materials with a second solvent. As a result, the colorant can be further well-dispersed in toner particles.

Examples of the solvent that can be used in the suspension granulation include hydrocarbons such as toluene, xylene, and hexane; halogen-containing hydrocarbons such as methylene chloride, chloroform, dichloroethane, trichloroethane, and carbon tetrachloride; alcohols such as methanol, ethanol, butanol, and isopropyl alcohol; polyols such as ethylene glycol, propylene glycol, diethylene glycol, and triethylene glycol; cellosolves such as methyl cellosolve and ethyl cellosolve; ketones such as acetone, methyl ethyl ketone, and methyl isobutyl ketone; ethers such as benzyl alcohol ethyl ether, benzyl alcohol isopropyl ether, and tetrahydrofuran; and esters such as methyl acetate, ethyl acetate, and butyl acetate. These solvents can be used alone or as a mixture of two or more thereof. Among these solvents, in order to easily remove the solvent in a toner particle suspension, a solvent having a low boiling point and capable of sufficiently dissolving the binder resin can be particularly used.

The amount of the solvent is preferably in a range of 50 to 5000 parts by mass and more preferably 120 to 1000 parts by mass based on 100 parts by mass of the binder resin.

The aqueous medium that is used in the suspension granulation can contain a dispersion stabilizing agent. The dispersion stabilizing agents that can be used in suspension polymerization can be similarly used. The amount of the dispersion stabilizing agent can be in a range of 0.01 to 20 parts by mass based on 100 parts by mass of the binder resin from the viewpoint of droplet stability of the solvent composition in the aqueous medium.

Production of Toner Particles by Pulverization

Production of toner particles by pulverization will be described.

In production of toner particles by pulverization, a colored resin powder containing a colorant and a binder resin, and optionally, a wax, a charge controlling agent, and other additives are used.

In pulverization, the toner can be produced using a known apparatus such as a mixer, a heat kneader, or a classifier.

A binder resin, a colorant, a wax, and a charge controlling agent, and optional other materials are sufficiently mixed with a mixer such as a Henschel mixer or a ball mill. The mixture is then melted with a heat kneader such as a roll, a kneader, or an extruder. Furthermore, a wax is dispersed in the resin compatibilized to other components by kneading and mixing. After cooling and solidification, a toner can be prepared by pulverization and classification.

The binder resins may be used alone or in combination of two or more thereof.

In a case of mixing two or more resins, resins having different molecular weights can be used for controlling the viscoelastic properties of the toner.

Production of Toner Particles by Emulsion Aggregation

A method of producing toner particles by emulsion aggregation will now be described.

A wax dispersion, a resin particle dispersion, a colorant particle dispersion, and a dispersion of other necessary toner components are prepared. Each dispersion contains a dispersoid and an aqueous medium. The aqueous medium is a medium of which main component is water. Examples of the aqueous medium include water itself, water containing a pH adjuster, and water containing an organic solvent.

Toner particles are prepared through a step (aggregation step) of aggregating the particles contained in the mixture of each dispersion to form aggregate particles, a step (fusion step) of heating the aggregate particles to fuse them, a step of washing, and a step of drying.

Each particle dispersion may contain a dispersant such as a surfactant. The colorant particles can be dispersed by a known method with a rotation shearing-type homogenizer, a media-type dispersing machine such as a ball mill, a sand mill, or an attritor, or a high-pressure counter-collision-type dispersing machine.

Examples of the surfactant include water-soluble polymers, inorganic compounds, and ionic or nonionic surfactants. Ionic surfactants advantageously have high dispersibility. In particular, anionic surfactants can be used.

The molecular weight of the surfactant is preferably 100 to 10000 and more preferably 200 to 5000, from the viewpoints of washing properties and surface-activating ability.

Examples of the surfactant include water-soluble polymers such as polyvinyl alcohol, methyl cellulose, carboxymethyl cellulose, and sodium polyacrylate; anionic surfactants such as sodium dodecylbenzenesulfonate, sodium octadecylsulfate, sodium oleate, sodium laurate, and potassium stearate; cationic surfactants such as laurylamine acetate and lauryltrimethyl ammonium chloride; zwitterionic surfactants such as lauryl dimethylamine oxide; nonionic surfactants such as polyoxyethylene alkyl ether, polyoxyethylene alkylphenyl ether, and polyoxyethylene alkylamine; and inorganic compounds such as tricalcium phosphate, aluminum hydroxide, calcium sulfate, calcium carbonate, and barium carbonate.

These surfactants may be used alone or in combination of two or more thereof as necessary.

The toner of the present invention can also be used in a developer that is used in liquid development (hereinafter, referred to as liquid developer).

Method of Producing Liquid Developer

A method of producing a liquid developer will now be described.

The liquid developer is prepared by dispersing or dissolving a colored resin powder (toner) containing a coloring compound represented by Formula (1) and optional auxiliary agents such as a charge controlling agent and a wax in an electric insulating carrier liquid. Alternatively, the developer may be produced by two stages of preparing a concentrated toner and diluting the concentrated toner with an electric insulating carrier liquid.

Any dispersant can be used, and a rotation shearing-type homogenizer, a media-type dispersing machine such as a ball mill, a sand mill, or an attritor, or a high-pressure counter-collision-type dispersing machine can be used.

The colored resin powder may further contain one or more colorants such as known pigments and dyes.

Examples of the wax and the colorant are the same as those described above.

The charge controlling agent may be any liquid developer for static charge development, and examples thereof include cobalt naphthenate, copper naphthenate, copper oleate, cobalt oleate, zirconium octoate, cobalt octoate, sodium dodecylbenzenesulfonate, calcium dodecylbenzenesulfonate, soybean lecithin, and aluminum octoate.

The electric insulating carrier liquid used in the present invention is not particularly limited. In particular, an organic solvent having an electric resistance of $10^9$ Ω·cm or more and a dielectric constant of 3 or less can be used.

Examples of the organic solvent include aliphatic hydrocarbon solvents such as hexane, pentane, octane, nonane, decane, undecane, and dodecane; and solvents having a boiling point in the range of 68° C. to 250° C., such as Isopar series H, G, K, L, and M (manufactured by Exxon Chemical Co., Ltd.) and Linealene Dimer series A-20 and A-20H (manufactured by Idemitsu Kosan Co., Ltd.). These may be used alone or in combination of two or more thereof within the range that does not increase the viscosity of the system.

EXAMPLES

The present invention will now be described in more detail by examples and comparative examples, but is not limited to these examples. Note that in the following description, "part(s)" and "%" are based on mass unless otherwise specified. Reaction products were identified by a plurality of analytical methods using the apparatuses described below. That is, analytical apparatuses used were ECA-400 (manufactured by JEOL Ltd.) for $^1$H nuclear magnetic resonance spectrometry (NMR) and autoflex (manufactured by Bruker Daltonics K.K.) for matrix-assisted laser desorption-ionization mass spectrometry (MALDI-MS). The detection by MALDI-MS was in the negative ion mode.

Synthesis Example 1

Production of Compound (1)

[Chem. 9]

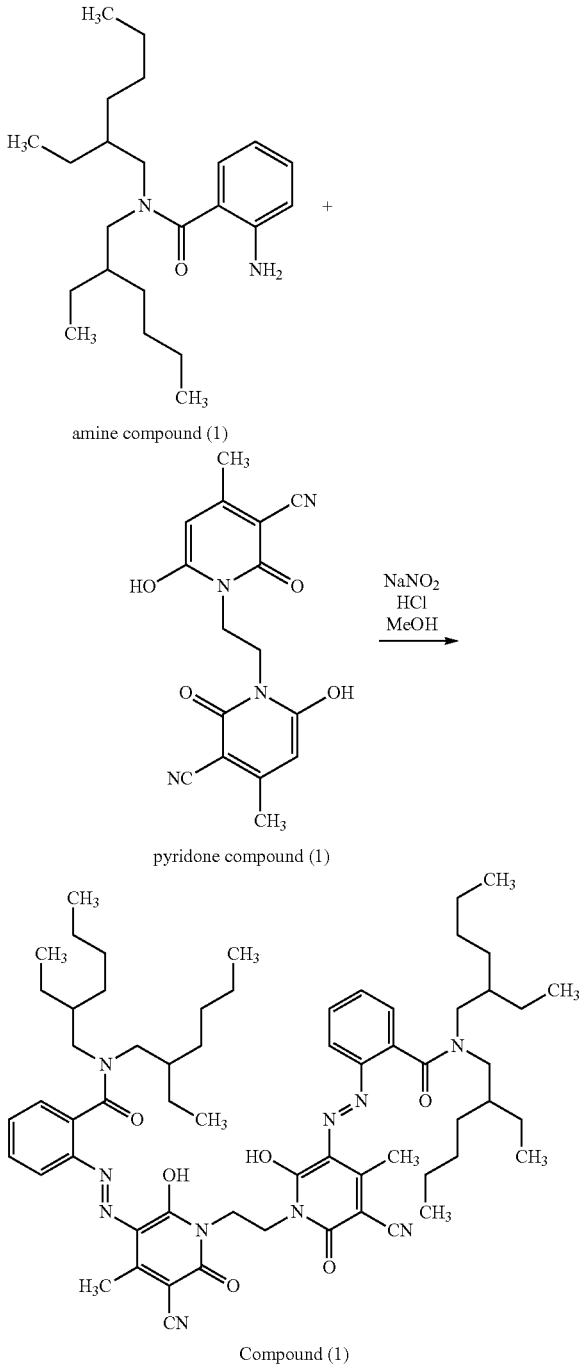

A solution of 2 g of amine compound (1) in 40 mL of methanol (MeOH) was cooled to 5° C., and 1.7 mL of 35% hydrochloric acid was dropwise added thereto. To this solution was dropwise added a solution of 0.48 g of sodium nitrite in 9 mL of water to give diazotization solution A. Separately, a solution of 0.90 g of pyridone compound (1) in 20 mL of methanol (MeOH) was cooled to 5° C., and diazotization solution A was dropwise added thereto slowly such that the temperature was maintained at 5° C. or less, followed by stirring at 0° C. to 5° C. for 3 hours. After completion of the reaction, the reaction solution was neutralized to a pH of 6 by dropwise addition of an aqueous solution of sodium carbonate, followed by extraction with chloroform. The resulting viscous material was purified by column chromatography (developing solvent: heptane/ethyl acetate) to yield 1.73 g of Compound (1).

Analytical Results of Compound (1)

[1] $^1$H-NMR (400 MHz, $CDCl_3$, room temperature): δ (ppm)=14.90 (2H, s), 7.83 (2H, d), 7.46 (2H, t), 7.29-7.22 (4H, m), 4.35-4.31 (4H, m), 3.24-3.20 (4H, m), 2.60 (6H, s), 1.83-1.80 (8H, m), 1.66-1.32 (18H, m), 1.28-0.83 (28H, m), 0.79-0.69 (5H, m), 0.66-0.60 (5H, m).

[2] Mass spectrometry by MALDI-TOF-MS: m/z=1067.363 $(M-2H)^{2-}$

Synthesis Example 2

Production of Compound (31)

A solution of 2 g of amine compound (31) in 40 mL of methanol (MeOH) was cooled to 5° C., and 1.7 mL of 35% hydrochloric acid was dropwise added thereto. To this solution was dropwise added a solution of 0.48 g of sodium nitrite in 9 mL of water to give diazotization solution A. Separately, a solution of 0.90 g of pyridone compound (31) in 20 mL of methanol (MeOH) was cooled to 5° C., and diazotization solution A was dropwise added thereto slowly such that the temperature was maintained at 5° C. or less, followed by stirring at 0° C. to 5° C. for 3 hours. After completion of the reaction, the reaction solution was neutralized to a pH of 6 by dropwise addition of an aqueous solution of sodium carbonate, followed by extraction with chloroform. The resulting viscous material was purified by column chromatography (developing solvent: heptane/ethyl acetate) to yield 1.48 g of Compound (31).

Analytical Results of Compound (31)

[1] $^1$H-NMR (400 MHz, $CDCl_3$, room temperature): δ (ppm)=14.90 (2H, s), 7.53-7.48 (6H, m), 7.29-7.25 (2H, m), 4.36 (4H, s), 3.52-3.32 (4H, m), 3.19 (4H, d), 2.61 (6H, s), 1.86-1.77 (2H, m), 1.60-1.50 (2H, m), 1.48-1.29 (16H, m),

[Chem. 10]

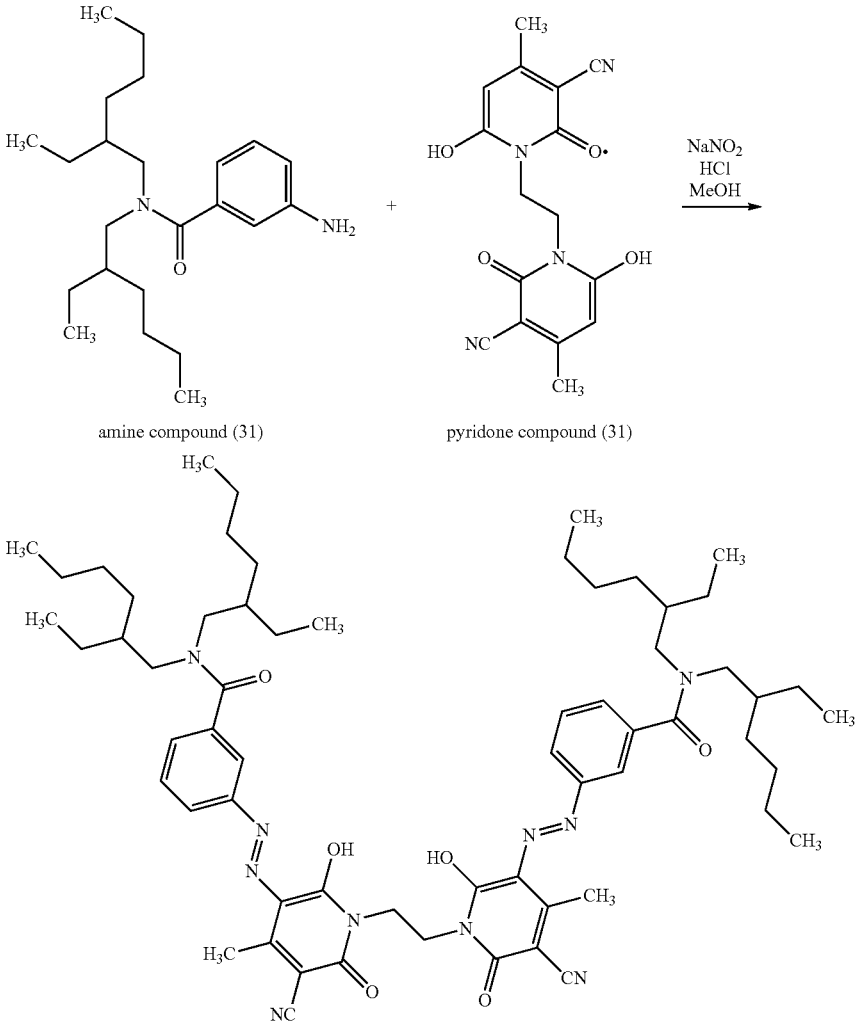

1.28-1.17 (6H, m), 1.16-1.02 (10H, m), 1.01-0.88 (12H, m), 0.86-0.81 (6H, m), 0.76-0.68 (6H, m).

[2] Mass spectrometry by MALDI-TOF-MS: m/z=1069.159 (M)

Synthesis Example 3

Production of Compound (32)

[Chem. 11]

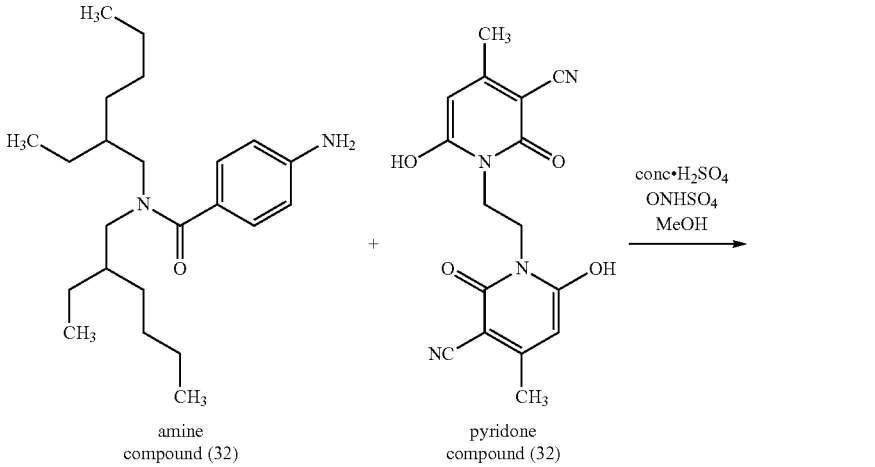

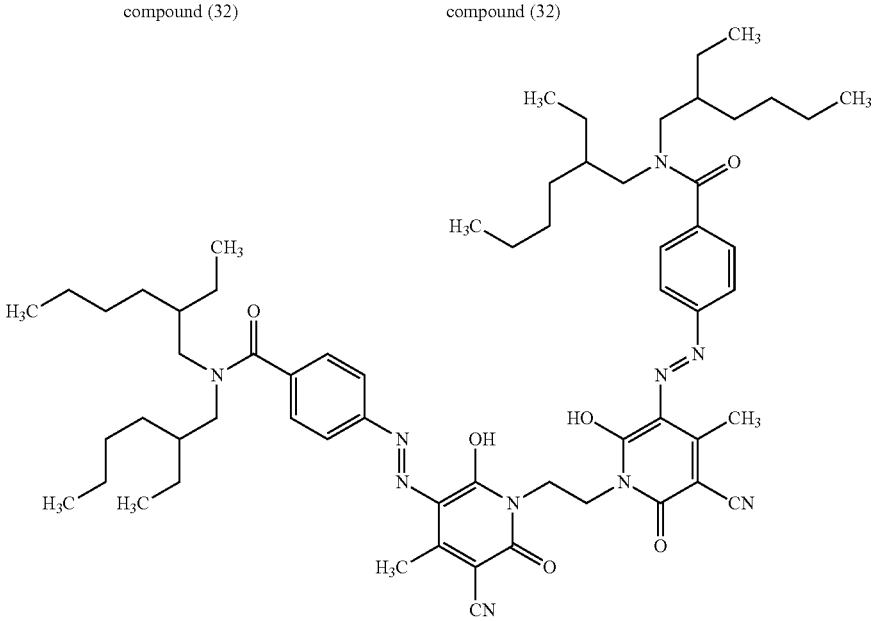

Compound (32)

A solution of 2 g of amine compound (32) in 40 mL of methanol (MeOH) was cooled to 5° C., and 6.9 mL of sulfuric acid and 1.76 mL of a 40% nitrosylsulfuric acid solution were dropwise slowly added thereto to give diazotization solution B. Separately, a solution of 0.90 g of pyridone compound (32) in 20 mL of methanol (MeOH) was cooled to 5° C., and diazotization solution B was dropwise added thereto slowly such that the temperature was maintained at 5° C. or less, followed by stirring at 0° C. to 5° C. for 3 hours. After completion of the reaction, the reaction solution was extracted with chloroform. The chloroform layer was concentrated, and the resulting solid was purified by column chromatography (developing solvent: heptane/ethyl acetate) to yield 1.48 g of Compound (32).

Analytical Results of Compound (32)

[1] $^1$H-NMR (400 MHz, $CDCl_3$, room temperature): δ (ppm)=14.90 (2H, s), 7.53-7.48 (8H, m), 4.36 (4H, s), 3.46-3.35 (4H, m), 3.22-3.18 (4H, m), 2.63 (6H, s), 1.86-1.77 (2H, m), 1.60-1.47 (2H, m), 1.45-1.00 (28H, m), 0.98-0.78 (18H, m), 0.76-0.65 (6H, m).

[2] Mass spectrometry by MALDI-TOF-MS: m/z=1069.068 (M)

Synthesis Examples 4 and 5

Production of Compounds (2) and (10)

Compounds (2) and (10) were prepared as in Synthesis Example 1 except that amine compound (1) and pyridone compound (1) in Synthesis Example 1 were replaced by corresponding amine compounds and pyridone compounds.

The target compounds were identified by the analysis mentioned above.

Analytical Results of Compound (10)

[1] $^1$H-NMR (400 MHz, $CDCl_3$, room temperature): δ (ppm)=14.95 (2H, s), 7.80 (2H, s), 7.33 (2H, d), 7.26 (2H, d), 4.33 (4H, s), 3.74-3.28 (6H, m), 3.24-3.12 (8H, m), 2.56 (6H, s), 1.84-0.68 (122H, m).

[2] Mass spectrometry by MALDI-TOF-MS: m/z=1604.218 (M)

Synthesis Examples 6 to 14

Production of Compounds (15), (21), (24), (25), (27), (34), (35), (36), and (40)

Compounds (15), (21), (24), (25), (27), (34), (35), (36), and (40) were prepared as in Synthesis Example 3 except that amine compound (32) and pyridone compound (32) in Synthesis Example 3 were replaced by corresponding amine compounds and pyridone compounds.

The target compounds were identified by the analysis mentioned above.

Analytical Results of Compound (21)

[1] $^1$H-NMR (400 MHz, $CDCl_3$, room temperature): δ (ppm)=14.80 (2H, s), 7.82 (2H, s), 7.59 (1H, t), 7.30-7.27 (4H, m), 7.21 (2H, d), 7.06 (1H, s), 3.46 (6H, d), 3.17 (8H, t), 2.64 (6H, s), 1.85-0.62 (122H, m).

[2] Mass spectrometry by MALDI-TOF-MS: m/z=1653.266 (M) Analytical results of Compound (27)

[1] $^1$H-NMR (400 MHz, $CDCl_3$, room temperature): δ (ppm)=15.76 (2H, s), 8.58 (2H, s), 8.15 (2H, d), 7.90 (2H, d), 4.45 (4H, s), 4.39-4.25 (8H, m), 2.63 (6H, s), 1.79-1.72 (4H, m), 1.56-1.32 (42H, m), 0.99-0.89 (24H, m).

[2] Mass spectrometry by MALDI-TOF-MS: m/z=1159.206 (M)

Analytical Results of Compound (34)

[1] $^1$H-NMR (400 MHz, $CDCl_3$, room temperature): δ (ppm)=14.88 (2H, s), 7.49 (4H, s), 7.18 (2H, s), 4.35 (4H, s), 3.45 (8H, dd), 3.18 (6H, d), 2.59 (6H, s), 1.91-1.70 (4H, br), 1.62-0.72 (122H, m).

[2] Mass spectrometry by MALDI-TOF-MS: m/z=1605.323 (M)

Analytical Results of Compound (35)

[1] $^1$H-NMR (400 MHz, $CDCl_3$, room temperature): δ (ppm)=14.99 (2H, s), 7.33-7.27 (6H, m), 4.30 (4H, s), 3.04 (8H, s), 2.51 (6H, s), 1.76-1.71 (3H, br), 1.58 (9H, s), 1.46-0.66 (116H, m)

[2] Mass spectrometry by MALDI-TOF-MS: m/z=1605.004 (M)

Analytical Results of Compound (36)

[1] $^1$H-NMR (400 MHz, $CDCl_3$, room temperature): δ (ppm)=14.76 (2H, s), 7.70 (1H, t), 7.45 (4H, s), 7.36 (2H, s), 7.18 (2H, s), 7.15 (1H, t), 3.47-3.39 (8H, m), 3.15 (6H, d), 2.65 (6H, s), 1.84-1.75 (3H, br), 1.58-0.73 (119H, m).

Analytical Results of Compound (40)

[1] $^1$H-NMR (400 MHz, $CDCl_3$, room temperature): δ (ppm)=14.89 (2H, s), 8.55 (2H, s), 8.30 (4H, s), 4.37 (4H, d), 4.35-4.27 (8H, m), 2.66 (6H, s), 1.76 (4H, t), 1.61-1.31 (38H, m), 1.02-0.89 (24H, m).

[2] Mass spectrometry by MALDI-TOF-MS: m/z=1159.219 (M)

Production of Toner

Toners of the present invention and comparative toners were produced by the processes described below.

Example 1

A mixture of 5 parts by mass of Compound (1) and 120 parts by mass of styrene was mixed with an attritor (manufactured by Mitsui Mining Co., Ltd.) for 3 hours to prepare dye dispersion (1) of Compound (1) dispersed in styrene.

A 2-L four-necked flask equipped with a high-speed stirring device, T.K. homomixer (manufactured by Primix Corp.) was charged with 710 parts by mass of ion exchange water and 450 parts by mass of a 0.1 mol/L trisodium phosphate aqueous solution, followed by heating to 60° C. with stirring at 12000 rpm. To this mixture was gradually added 68 parts by mass of a 1.0 mol/L calcium chloride aqueous solution to prepare an aqueous dispersion medium containing fine calcium phosphate.

The following materials:

dye dispersion (1): 133.2 parts by mass, styrene: 46.0 parts by mass, n-butyl acrylate: 34.0 parts by mass, aluminum salicylate compound (Bontron E-88, manufactured by Orient Chemical Industries, Ltd.): 2.0 parts by mass, polar resin (polycondensate of propylene oxide-modified bisphenol A and isophthalic acid, Tg: 65° C., Mw: 10000, Mn: 6000): 10.0 parts by mass, ester wax (maximum endothermic peak temperature measured by DSC: 70° C., Mn: 704): 25.0 parts by mass, and divinylbenzene: 0.10 parts by mass were heated to 60° C. and were uniformly mixed and dispersed with a T.K. homomixer at 5000 rpm. In this mixture was dissolved 10 parts by mass of 2,2'-azobis(2,4-dimethylvaleronitrile) as a polymerization initiator to prepare a polymerizable monomer composition. This polymerizable monomer composition was put in the aqueous medium prepared above, followed by granulation at 12000 rpm for 15 minutes. Subsequently, the high-speed stirring device was changed to a propeller stirring blade, and polymerization was continued at a solution temperature of 60° C. for 5 hours and then at a solution temperature of 80° C. for 8 hours. After completion of the polymerization, the residual monomer was distilled away at 80° C. under reduced pressure, and the solution temperature was then reduced to 30° C. to give polymer microparticle dispersion (1).

Polymer microparticle dispersion (1) was transferred to a washing container, and diluted hydrochloric acid was added to the dispersion with stirring to adjust the pH to 1.5. The dispersion was further stirred for 2 hours and was then subjected to solid-liquid separation with a filter to obtain polymer microparticles (1). Polymer microparticles (1) were repeatedly subjected to redispersion into water and solid-liquid separation until phosphoric acid and calcium compounds including calcium phosphate were thoroughly removed. Subsequently, polymer microparticles finally prepared by solid-liquid separation were sufficiently dried with a dryer to yield toner particles (1)

Toner (1) of the present invention was prepared by mixing 100 parts by mass of the resulting toner particles (1) with 1.00 parts by mass of a hydrophobic silica fine powder (primary particle number-average particle diameter: 7 nm) surface-treated with hexamethyldisilazane, 0.15 parts by mass of a rutile-type titanium oxide fine powder (primary particle number-average particle diameter: 45 nm), and 0.50 parts by mass of a rutile-type titanium oxide fine powder (primary particle number-average particle diameter: 200 nm) by dry blending with a Henschel mixer (manufactured by Nippon Coke & Engineering Co., Ltd.) for 5 minutes.

Examples 2 to 6

Toners (2) to (6) of the present invention were prepared as in Example 1 except that 6 parts by mass of Compound (10), 5 parts by mass of Compound (21), 7 parts by mass of Compound (24), 5 parts by mass of Compound (31), and 5 parts by mass of Compound (34) were respectively used in place of 5 parts by mass of Compound (1) in Example 1.

Comparative Examples 1 and 2

Comparative toners (Com. 1) and (Com. 2) were prepared as in Example 1 except that Comparative Compounds (1) and (2) were respectively used in place of Compound (1) in Example 1.

The structures of Comparative Compounds (1) and (2) are shown below.

[Chem. 12]

Comparative Compound (1)

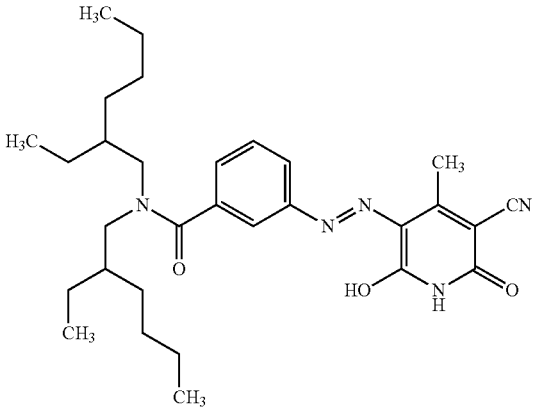

[Chem. 13]

Comparative Compound (2)

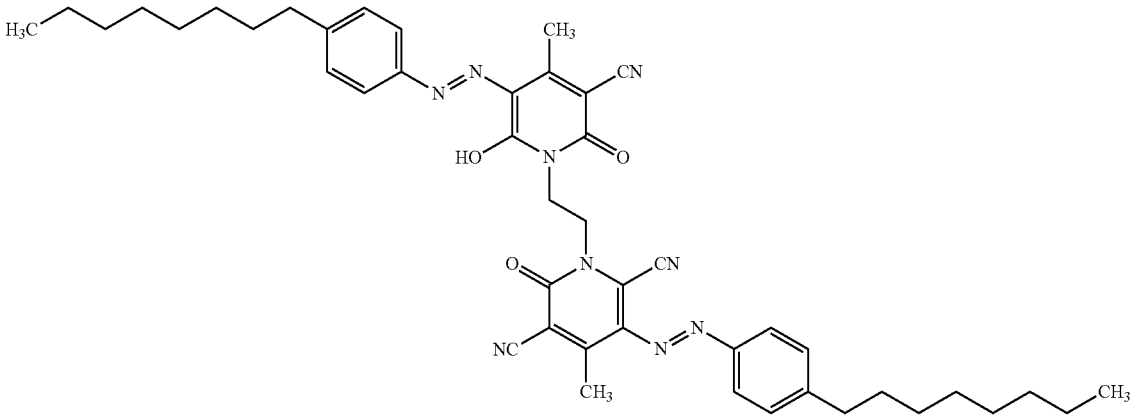

Example 7

A mixture solution was prepared by mixing 82.6 parts by mass of styrene, 9.2 parts by mass of n-butyl acrylate, 1.3 parts by mass of acrylic acid, 0.4 parts by mass of hexanediol acrylate, and 3.2 parts by mass of n-lauryl mercaptane. To this mixture solution was added an aqueous solution of 1.5 parts by mass of Neogen RK (manufactured by Daiichi Kogyo Seiyaku Co., Ltd.) in 150 parts by mass of ion exchange water, followed by dispersion treatment. An aqueous solution of 0.15 parts by mass of potassium persulfate in 10 parts by mass of ion exchange water was added to the dispersion with slowly stirring for 10 minutes. After nitrogen purge, emulsion polymerization was performed at 70° C. for 6 hours. After completion of the polymerization, the reaction solution was cooled to room temperature. Ion exchange water was then added to the solution to give resin particle dispersion (7) having a solid concentration of 12.5% by mass and a volume-based median diameter of 0.2 μm.

Wax dispersion (7) was prepared by mixing 100 parts by mass of ester wax (maximum endothermic peak temperature measured by DSC: 70° C., Mn: 704) and 15 parts by mass of Neogen RK with 385 parts by mass of ion exchange water and subjecting the mixture to dispersion treatment with a wet-type jet mill JN100 (manufactured by Jokoh Co., Ltd.) for about 1 hour. The concentration of wax dispersion (7) was 20% by mass.

Colorant particle dispersion (7) was prepared by mixing 100 parts by mass of Compound (1) and 15 parts by mass of Neogen RK with 885 parts by mass of ion exchange water and subjecting the mixture to dispersion treatment with a wet-type jet mill JN100 (manufactured by Jokoh Co., Ltd.) for about 1 hour.

The colorant particles in colorant particle dispersion (5) had a volume-based median diameter of 0.2 μm and a concentration of 10% by mass.

A mixture of 160 parts by mass of resin particle dispersion (7), 10 parts by mass of wax dispersion (7), 10 parts by mass of colorant particle dispersion (7), and 0.2 parts by mass of magnesium sulfate was subjected to dispersion treatment with a homogenizer (Ultra Turrax T50, manufactured by IKA Japan K.K.). The dispersion was then heated to 65° C. with stirring and was further stirred at 65° C. for 1 hour. Observation with an optical microscope of the dispersion demonstrated that aggregate particles having an average particle diameter of about 6.0 μm were formed. To this dispersion was added 2.2 parts by mass of Neogen RK (manufactured by Daiichi Kogyo Seiyaku Co., Ltd.). The mixture was then heated to 80° C. and was then stirred for 120 minutes to give fused spherical toner particles. After cooling, the solid content was collected by filtration and was washed in 720 parts by mass of ion exchange water by stirring for 60 minutes. The solution containing the toner particles was filtered, and the washing process was repeated until the conductance of the filtrate was reduced to 150 μS/cm or less. The toner particles were dried with a vacuum dryer to yield toner particles (7).

Toner (7) was prepared by mixing 100 parts by mass of toner particles (7) with 1.8 parts by mass of a hydrophobized silica fine powder having a specific surface area of 200 $m^2/g$, measured by a BET method, by dry blending with a Henschel mixer (manufactured by Mitsui Mining Co., Ltd.).

Examples 8 to 10

Toners (8) to (10) were prepared as in Example 7 except that 60 parts by mass of Compound (2), 90 parts by mass of Compound (27), and 80 parts by mass of Compound (32) were respectively used in place of 100 parts by mass of Compound (1) in Example 7.

Comparative Examples 3 and 4

Comparative toners (Com. 3) and (Com. 4) were prepared as in Example 7 except that Comparative Compounds (1) and (2) were respectively used in place of Compound (1) in Example 7.

Example 11

A mixture of 100 parts by mass of a binder resin (polyester resin, Tg: 55° C., acid value: 20 mg KOH/g, hydroxyl value: 16 mg KOH/g, peak molecular weight Mp: 4500, number-average molecular weight Mn: 2300, weight-average molecular weight Mw: 38000), 5 parts by mass of Compound (15), 0.5 parts by mass of aluminum 1,4-di-t-butylsalicylate compound, and 5 parts by mass of paraffin wax (maximum endothermic peak temperature: 78° C.) was prepared by sufficiently mixing them with a Henschel mixer (model FM-75J, manufactured by Mitsui Mining Co., Ltd.). The mixture was kneaded with a biaxial kneader (model PCM-45, manufactured by Ikegai Corp.) at a temperature of 130° C. at a feeding rate of 60 kg/hr (the temperature of kneaded product when it was discharged was about 150° C.). The resulting kneaded product was cooled, was roughly pulverized with a hammer mill, and was then finely pulverized with a mechanical pulverizer (T-250, manufactured by Freund-Turbo Corporation) at a feeding rate of 20 kg/hr.

The finely pulverized toner product was further classified with a multi-division classifier utilizing the Coanda effect to obtain toner particles.

Toner (11) was prepared by mixing 100 parts by mass of the resulting toner particles with 1.8 parts by mass of a hydrophobized silica fine powder having a specific surface area of 200 $m^2/g$, measured by a BET method, by dry blending with a Henschel mixer (manufactured by Mitsui Mining Co., Ltd.).

Examples 12 to 14

Toners (12) to (14) were prepared as in Example 11 except that Compound (25), Compound (36), and Compound (40) were respectively used in place of Compound (15) in Example 11.

Comparative Examples 5 and 6

Comparative toners (Com. 5) and (Com. 6) were prepared as in Example 8 except that Comparative Compounds (1) and (2) were respectively used in place of Compound (15) in Example 8.

Example 15

Toner (15) was prepared as in Example 1 except that 4 parts by mass of C.I. Pigment Yellow 185 (manufactured by BASF, trade name: "PALIOTOL Yellow D1155") and 3 parts by mass of Compound (1) were used in place of 5 parts by mass of Compound (1) in Example 1.

Example 16

Toner (16) was prepared as in Example 1 except that 3 parts by mass of C.I. Pigment Yellow 155 (manufactured by Clariant, trade name: "Toner Yellow 3GP") and 3 parts by mass of Compound (21) were used in place of 5 parts by mass of Compound (1) in Example 1.

Example 17

Colorant particle dispersion (17) was prepared by mixing 100 parts by mass of C.I. Pigment Yellow 180 (manufactured by DIC Corporation, trade name: "SYMULER Fast Yellow BY2000GT") 15 parts by mass of Neogen RK with 885 parts by mass of ion exchange water and subjecting the mixture to dispersion treatment with a wet-type jet mill JN100 (manufactured by Jokoh Co., Ltd.) for about 1 hour.

The volume-based median diameter of the colorant particles dispersed in colorant particle dispersion (17) was 0.2 μm.

Toner (17) was produced as in Example 7 except that 3 parts by mass of colorant particle dispersion (7) and 3 parts by mass of colorant particle dispersion (17) were used in place of 10 parts by mass of colorant particle dispersion (7) in Example 7.

Yellow toner (17) was prepared by mixing 100 parts by mass of the resulting toner particles with 1.8 parts by mass of a hydrophobized silica fine powder having a specific surface area of 200 $m^2/g$, measured by a BET method, by dry blending with a Henschel mixer (manufactured by Mitsui Mining Co., Ltd.).

Example 18

A mixture of 100 parts by mass of a binder resin (polyester resin, Tg: 55° C., acid value: 20 mg KOH/g, hydroxyl value: 16 mg KOH/g, Mp: 4500, Mn: 2300, Mw: 38000), 3 parts by mass of C.I. Pigment Yellow 155 (manufactured by Clariant, trade name: "Toner Yellow 3GP"), 3 parts by mass of Compound (15), 0.5 parts by mass of aluminum 1,4-di-t-butylsalicylate compound, and 5 parts by mass of paraffin wax (maximum endothermic peak temperature: 78° C.) was prepared by sufficiently mixing them with a Henschel mixer (model FM-75J, manufactured by Mitsui Mining Co., Ltd.). The mixture was kneaded with a biaxial kneader (model PCM-45, manufactured by Ikegai Corp.) at a temperature of 130° C. at a feeding rate of 60 kg/hr (the temperature of kneaded product when it was discharged was about 150° C.). The resulting kneaded product was cooled, was roughly pulverized with a hammer mill, and was then finely pulverized with a mechanical pulverizer (T-250, manufactured by Freund-Turbo Corporation) at a feeding rate of 20 kg/hr.

The resulting finely pulverized toner product was further classified with a multi-division classifier utilizing the Coanda effect to obtain toner particles.

Toner (18) was prepared by mixing 100 parts by mass of the resulting toner particles with 1.8 parts by mass of a hydrophobized silica fine powder having a specific surface area of 200 $m^2/g$, measured by a BET method, by dry blending with a Henschel mixer (manufactured by Mitsui Mining Co., Ltd.).

The particle size distribution of the toners produced by suspension polymerization was measured for investigating the characteristics of each dispersion of a coloring compound in a polymerizable monomer. A decrease in the granulating ability or heterogeneity in the dispersion of a coloring compound due to an increase in viscosity of a dispersion tends to broaden the particle size distribution.

As an indicator of the particle size distribution of a toner, a ratio, D4/D1, of the number-average particle diameter (D1) to the weight-average particle diameter (D4) was used.

The weight-average particle diameter and the number-average particle diameter were measured as follows.

The number-average particle diameter (D1) and the weight-average particle diameter (D4) of a toner were measured by particle size distribution analysis in accordance with a Coulter method. As the measurement apparatus, Coulter Counter TA-II or Coulter Multisizer II (manufactured by Beckman Coulter, Inc.), was used in accordance with the operation manual of the apparatus. An about 1% aqueous solution of sodium chloride was prepared using primary sodium chloride as an electrolytic solution. For example, ISOTON-II (manufactured by Coulter Scientific Japan) can be used. Specifically, 0.1 to 5 mL of a surfactant (e.g., alkylbenzenesulfonate) serving as a dispersant is added to 100 to 150 mL of the aqueous electrolyte solution, and 2 to 20 mg of a sample (toner) to be measured is added thereto. The electrolytic solution suspending the sample is subjected to dispersion treatment with a supersonic disperser for about 1 to 3 minutes. The dispersion-treated solution was subjected to measurement of the volume and the number of toner particles having a size of 2.00 μm or more with the measurement apparatus equipped with apertures of 100 μm to calculate the volume distribution and the number distribution of each toner. The number-average particle diameter (D1) determined from the number distribution of a toner and the weight-average particle diameter (D4) determined from the volume distribution of the toner (the median value of each channel is defined as the representative value of the channel) and the ratio D4/D1 were determined.

As the channels, 13 channels: 2.00 to 2.52 μm, 2.52 to 3.17 μm, 3.17 to 4.00 μm, 4.00 to 5.04 μm, 5.04 to 6.35 μm, 6.35 to 8.00 μm, 8.00 to 10.08 μm, 10.08 to 12.70 μm, 12.70 to 16.00 μm, 16.00 to 20.20 μm, 20.20 to 25.40 μm, 25.40 to 32.00 μm, and 32.00 to 40.30 μm were used.

The particle size distribution was evaluated on the following criteria, and a ratio D4/D1 of less than 1.35 was determined as a satisfactory particle size distribution.

A: a ratio D4/D1 of less than 1.30,

B: a ratio D4/D1 of 1.30 or higher and less than 1.35, and

C: a ratio D4/D1 of 1.35 or higher.

The evaluation results of Examples are shown in Table 1. In Table 1, PY185, PY180, and PY155 mean C.I. Pigment Yellow 185, C.I. Pigment Yellow 180, and C.I. Pigment Yellow 155, respectively.

TABLE 1

| | Toner No. | Compound No. | Toner | D4 | D4/D1 | particle size distribution |
|---|---|---|---|---|---|---|
| Example 1 | 1 | 1 | suspension polymerization | 5.95 | 1.22 | A |
| Example 2 | 2 | 10 | suspension polymerization | 5.67 | 1.19 | A |
| Example 3 | 3 | 21 | suspension polymerization | 6.71 | 1.25 | A |
| Example 4 | 4 | 24 | suspension polymerization | 6.78 | 1.26 | A |
| Example 5 | 5 | 31 | suspension polymerization | 5.88 | 1.23 | A |
| Example 6 | 6 | 34 | suspension polymerization | 5.84 | 1.27 | A |
| Example 7 | 7 | 1 | emulsion aggregation | 6.39 | 1.22 | — |
| Example 8 | 8 | 2 | emulsion aggregation | 6.44 | 1.21 | — |
| Example 9 | 9 | 27 | emulsion aggregation | 6.09 | 1.21 | — |
| Example 10 | 10 | 32 | emulsion aggregation | 6.27 | 1.24 | — |
| Example 11 | 11 | 15 | pulverization | 6.01 | 1.29 | — |
| Example 12 | 12 | 25 | pulverization | 6.22 | 1.24 | — |
| Example 13 | 13 | 36 | pulverization | 6.03 | 1.27 | — |
| Example 14 | 14 | 40 | pulverization | 6.17 | 1.26 | — |
| Example 15 | 15 | PY185/1 | suspension polymerization | 6.88 | 1.30 | B |
| Example 16 | 16 | PY155/21 | suspension polymerization | 6.92 | 1.30 | B |
| Example 17 | 17 | PY180/1 | emulsion aggregation | 5.74 | 1.21 | — |
| Example 18 | 18 | PY155/15 | pulverization | 6.06 | 1.26 | — |
| Comparative Example 1 | Com. 1 | Com. 1 | suspension polymerization | 6.93 | 1.33 | B |
| Comparative Example 2 | Com. 2 | Com. 2 | suspension polymerization | 7.31 | 1.54 | C |
| Comparative Example 3 | Com. 3 | Com. 1 | emulsion aggregation | 6.41 | 1.27 | — |
| Comparative Example 4 | Com. 4 | Com. 2 | emulsion aggregation | 6.55 | 1.24 | — |
| Comparative Example 5 | Com. 5 | Com. 1 | pulverization | 6.33 | 1.29 | — |
| Comparative Example 6 | Com 6 | Com. 2 | pulverization | 6.13 | 1.28 | — |

The results shown in Table 1 demonstrate that even if a toner is produced by suspension polymerization, the toner can have a satisfactory particle size distribution.

Evaluation of Image Sample

Image samples were printed using toners (1) to (12) and (Com. 1) to (Com. 6) described above, and the image characteristics described below were comparatively evaluated. Before the comparison of image characteristics, the image forming apparatus was checked for the paper-feeding durability. The apparatus used was LBP-5300 (manufactured by CANON KABUSHIKI KAISHA) modified such that the developing blade in the process cartridge (hereinafter referred to as CRG) was replaced by an SUS blade having a thickness of 8 μm and such that a blade bias of −200 V can be applied to the developing bias to be applied to the developing roller serving as a toner carrier.

The evaluation was performed using the CRG filled with the individual yellow toner for each evaluation item. The CRG filled with a toner was set to the image forming apparatus, and the following evaluation items were evaluated. The evaluation results are shown in Table 2.

(1) Measurement of Chromaticity (L*, a*, b*)

Each of image samples formed using the yellow toners (1) to (12) and (Com. 1) to (Com. 6) described above was measured for chromaticity (L*, a*, b*) in the L*a*b color system with a reflection densitometer, SpectroLino (manufactured by Gretag Macbeth AG).

(2) Evaluation of Light Resistance of Toner

Each of the image samples prepared in the chromaticity measurement was charged in a xenon tester (Atlas Ci4000, manufactured by Suga Test Instruments Co., Ltd.) and was exposed to conditions: an illuminance of 0.39 W/m$^2$ at 340 nm, a temperature of 40° C., and a relative humidity of 60%, for 80 hours. The reflection densities of printed matters were measured before and after the test. The color difference ΔE was calculated from the initial chromaticity values $a_0$*, $b_0$*, and $L_0$* and the chromaticity values a*, b*, and L* after the exposure by the following expression:

$$\Delta E=\sqrt{(a^*-a_0^*)^2+(b^*-b_0^*)^2+(L^*-L_0^*)^2} \quad \text{[Math. 1]}$$

The evaluation criteria are as follows:

A: ΔE<5.0 (excellent light resistance)

B: 5.0≤ΔE<10.0 (good light resistance)

C: 10.0≤ΔE (poor light resistance)

(3) Evaluation of Saturation

The saturation was evaluated as follows:

A higher saturation C* in the same colorant amount per unit area means a higher increase in saturation. The saturation was evaluated by the initial value of the saturation C* at the production of the image sample. Each C* is calculated by the following expression:

$$C^*=\sqrt{(a^*)^2+(b^*)^2} \quad \text{[Math. 2]}$$

The evaluation criteria are as follows:

A: C*≥112 (a very high increase in saturation)

B: 112>C*≥108 (a high increase in saturation)

C: 108>C* (a poor increase in saturation)

TABLE 2

| | Toner No. | Compound No. | Toner | ΔE after 50 hr | Light resistance evaluation | Saturation c* | Saturation evaluation |
|---|---|---|---|---|---|---|---|
| Example 1 | 1 | 1 | suspension polymerization | 2.5 | A | 120 | A |
| Example 2 | 2 | 10 | suspension polymerization | 1.9 | A | 118 | A |
| Example 3 | 3 | 21 | suspension polymerization | 1.7 | A | 119 | A |
| Example 4 | 4 | 24 | suspension polymerization | 3.8 | A | 113 | A |
| Example 5 | 5 | 31 | suspension polymerization | 2.4 | A | 119 | A |
| Example 6 | 6 | 34 | suspension polymerization | 4.7 | A | 113 | A |
| Example 7 | 7 | 1 | emulsion aggregation | 4.8 | A | 120 | A |
| Example 8 | 8 | 2 | emulsion aggregation | 4.9 | A | 119 | A |
| Example 9 | 9 | 27 | emulsion aggregation | 4.0 | A | 112 | A |
| Example 10 | 10 | 32 | emulsion aggregation | 4.6 | A | 115 | A |
| Example 11 | 11 | 15 | pulverization | 3.9 | A | 112 | A |
| Example 12 | 12 | 25 | pulverization | 4.6 | A | 112 | A |
| Example 13 | 13 | 36 | pulverization | 1.8 | A | 114 | A |
| Example 14 | 14 | 40 | pulverization | 3.9 | A | 114 | A |
| Example 15 | 15 | PY185/1 | suspension polymerization | 1.1 | A | 116 | A |
| Example 16 | 16 | PY155/21 | suspension polymerization | 1.2 | A | 112 | A |
| Example 17 | 17 | PY180/1 | emulsion aggregation | 3.3 | A | 113 | A |
| Example 18 | 18 | PY155/15 | pulverization | 2.9 | A | 112 | A |
| Comparative Example 1 | Com. 1 | Com. 1 | suspension polymerization | 6.4 | B | 109 | B |
| Comparative Example 2 | Com. 2 | Com. 2 | suspension polymerization | 10.3 | C | 98 | C |
| Comparative Example 3 | Com. 3 | Com. 1 | emulsion aggregation | 7.1 | B | 111 | B |
| Comparative Example 4 | Com. 4 | Com. 2 | emulsion aggregation | 11.8 | C | 107 | C |
| Comparative Example 5 | Com. 5 | Com. 1 | pulverization | 5.9 | B | 110 | B |
| Comparative Example 6 | Com. 6 | Com. 2 | pulverization | 8.9 | B | 104 | C |

The results shown in Table 2 demonstrate that toners produced by the present invention are excellent in both saturation and light resistance in every production process, compared to the corresponding comparative toners. Furthermore, as shown in the results of Examples 15 to 18, a toner containing a pigment also can be used without any problem.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-201703, filed Sep. 27, 2013, which is hereby incorporated by reference herein in its entirety.

INDUSTRIAL APPLICABILITY

The present invention can provide a toner excellent in both saturation and light resistance.

The invention claimed is:

1. A toner comprising:

a binder resin; and a colorant, wherein the colorant is a coloring compound represented by Formula (1):

[Chem. 1]

Formula (1)

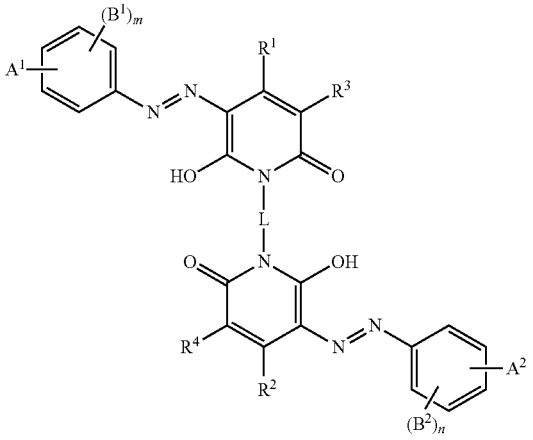

wherein $R^1$ and $R^2$ each independently represent an alkyl group, an aryl group, or an amino group;

$R^3$ and $R^4$ each independently represent a hydrogen atom, a cyano group, a carbamoyl group, a carboxylic acid ester group, or a carboxylic acid amido group;

m and n each independently represent an integer of 0 to 4;

$A^1$, $A^2$, $B^1$ when m is 1 to 4, and $B^2$ when n is 1 to 4 each independently represent a carboxylic acid ester group, a sulfonic acid ester group, a carboxylic acid amido group, or a sulfonic acid amido group; and L represents a straight chain alkylene group having 1 to 12 carbon atoms, a branched alkylene group having 1 to 12 carbon atoms, or a phenylene group.

2. The toner according to claim 1, wherein in Formula (1), $A^1$, $A^2$, $B^1$ when m is 1 to 4, and $B^2$ when n is 1 to 4 each independently represent a sulfonic acid ester group, a carboxylic acid amido group, or a sulfonic acid amido group; and L represents a phenylene group.

3. The toner according to claim 1, wherein in Formula (1), $A^1$, $A^2$, $B^1$ when m is 1 to 4, and $B^2$ when n is 1 to 4 each independently represent a carboxylic acid amido group; and L represents a straight chain alkylene group having 1 to 12 carbon atoms or a branched alkylene group having 1 to 12 carbon atoms.

4. The toner according to claim 1, wherein in Formula (1), at least one of $A^1$ and $A^2$ represents a carboxylic acid dialkylamido group.

5. The toner according to claim 1, wherein in Formula (1), at least one of $A^1$ and $A^2$ represents a carboxylic acid di(2-ethylhexyl)amido group.

6. The toner according to claim 1, wherein in Formula (1), L represents an ethylene group.

7. The toner according to claim 1, wherein in Formula (1), the partial structures on both sides of L have the same structure.

8. The toner according to claim 1, produced by suspension polymerization or emulsion aggregation.

* * * * *